US009004974B2

(12) United States Patent
Brooks et al.

(10) Patent No.: US 9,004,974 B2
(45) Date of Patent: Apr. 14, 2015

(54) MINIATURE CUSTOMIZABLE ROOM BUILDING TOY COMPONENTS

(71) Applicant: Maykah, Inc., Mountain View, CA (US)

(72) Inventors: Alice Pattaranee Brooks, Palo Alto, CA (US); Bettina Jade-Ming Chen, Santa Clara, CA (US)

(73) Assignee: Maykah, Inc., Mountain View, CA (US)

( * ) Notice: Subject to any disclaimer, the term of this patent is extended or adjusted under 35 U.S.C. 154(b) by 209 days.

(21) Appl. No.: 13/842,959

(22) Filed: Mar. 15, 2013

(65) Prior Publication Data

US 2014/0030951 A1 Jan. 30, 2014

Related U.S. Application Data

(60) Provisional application No. 61/675,299, filed on Jul. 24, 2012.

(51) Int. Cl.
*A63H 33/08* (2006.01)
*A63H 33/10* (2006.01)

(52) U.S. Cl.
CPC ..... *A63H 33/10* (2013.01); *A63H 33/084* (2013.01); *A63H 33/088* (2013.01); *A63H 33/105* (2013.01); *A63H 33/108* (2013.01)

(58) Field of Classification Search
USPC ..... 446/108, 109, 113, 114, 115, 116, 124, 446/125
See application file for complete search history.

(56) References Cited

U.S. PATENT DOCUMENTS

| | | | | | |
|---|---|---|---|---|---|
| 1,678,709 | A * | 7/1928 | Schurmann | 464/150 |
| 2,984,935 | A * | 5/1961 | Beck | 446/114 |
| 3,564,758 | A * | 2/1971 | Willis | 446/109 |
| 4,789,370 | A * | 12/1988 | Ellefson | 446/113 |
| 5,163,862 | A * | 11/1992 | Philips et al. | 446/114 |
| 5,273,477 | A * | 12/1993 | Adams, Jr. | 446/108 |
| 5,628,666 | A * | 5/1997 | Tomczyk et al. | 446/125 |
| 5,672,087 | A * | 9/1997 | De La Paz Rizo et al. | 446/46 |
| D398,337 | S * | 9/1998 | LaPointe | D21/484 |
| 5,833,512 | A * | 11/1998 | Nicola | 446/114 |
| 6,149,487 | A * | 11/2000 | Peng | 446/114 |
| 6,176,757 | B1 * | 1/2001 | Lin | 446/115 |
| 6,179,681 | B1 * | 1/2001 | Matos | 446/116 |
| 6,626,732 | B1 * | 9/2003 | Chung | 446/387 |
| 7,273,404 | B2 * | 9/2007 | Kowalski et al. | 446/92 |
| 7,318,764 | B2 * | 1/2008 | Elias | 446/108 |
| D591,007 | S * | 4/2009 | O'Neill | D30/121 |
| D605,236 | S * | 12/2009 | Sinisi et al. | D21/502 |
| 8,684,466 | B2 * | 4/2014 | Blair | 297/440.13 |

* cited by examiner

*Primary Examiner* — Kurt Fernstrom
(74) *Attorney, Agent, or Firm* — Beyer Law Group LLP

(57) ABSTRACT

A building toy component comprises a main body having opposing top and bottom surfaces and a thickness. The building toy component also comprises at least one slot that opens on a peripheral edge of the main body, wherein a nominal width of the slot is substantially equal to the thickness of the main body. The slot includes opposing sidewall having at least one engagement strip within each slot. In particular, each engagement strip extends traversely across a sidewall of the slot and tapers along a height of the sidewall.

20 Claims, 50 Drawing Sheets

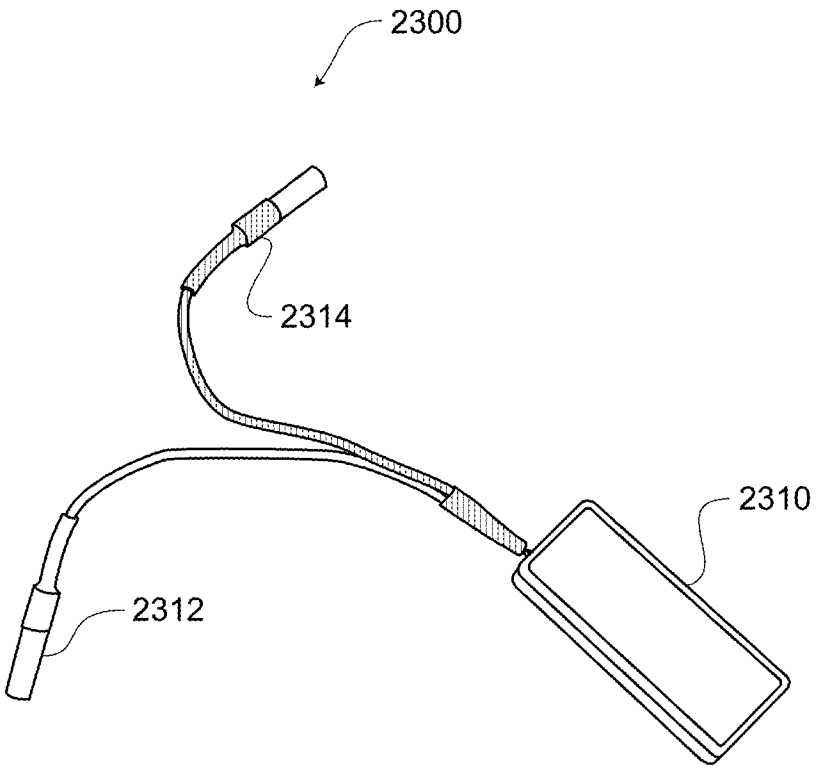
FIG. 23
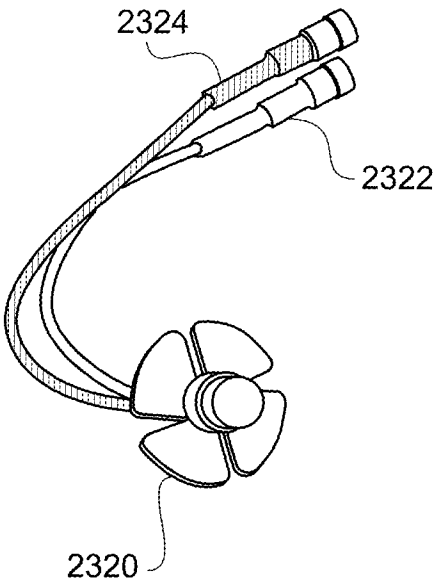

MINIATURE CUSTOMIZABLE ROOM BUILDING TOY COMPONENTS

CROSS-REFERENCE TO RELATED APPLICATIONS

This application claims benefit to U.S. Provisional Patent Application No. 61/675,299 filed Jul. 24, 2012 entitled "MINIATURE CUSTOMIZABLE ROOM BUILDING COMPONENTS," which is incorporated herein by reference for all purposes.

BACKGROUND OF THE INVENTION

1. Field of the Invention

The present disclosure relates to miniature room building toy components. In particular, the present disclosure relates to miniature room building toy components having coupling elements, such as tabs and slots, which are compatible with each other. As such, miniature rooms may be customized to a user's preference, whether the rooms are created as a toy, a hobby, a craft, or a combination thereof.

2. Background

The use of toys to instruct children on integrating electronics into room-building toy components encourages the education of engineering concepts in a creative environment.

SUMMARY OF THE INVENTION

An embodiment of the present invention includes a building toy component. The building toy component comprises a main body that has a generally circular geometry, the main body having opposing top and bottom surfaces, a radius, and thickness. The building toy component also comprises at least one radially extending slot that opens on a peripheral edge of the main body, wherein a nominal width of the slot is substantially equal to the thickness of the main body, the slot including opposing sidewalls that are slightly splayed relative to one another such that a width of the slot is wider on the top surface of the main body than at the bottom surface of the main body. Additionally, the building toy component comprises at least one engagement strip within each slot, wherein each engagement strip extends traversely across a sidewall of the slot and tapers along a height of the sidewall.

Another embodiment of the present invention includes another building toy component. The building toy component comprises a main body that has a generally rectangular geometry, the main body having opposing top and bottom surfaces, a length, a width, and a thickness. The building toy component also comprises at least one slot that opens on the top and bottom surfaces of the main body, the slot having a length, a width, and two opposing sidewalls, wherein the at least one slot extends from a first point along the width of the main body to a second point along the length of the main body, wherein the length of the slot equals the thickness of the main body. Further, the building toy component comprises at least one engagement strip within each slot, wherein each engagement strip extends traversely across a sidewall of the slot and tapers along the height of the sidewall.

A further embodiment of the present invention includes a toy room-building kit. The toy room-building kit comprises a building toy component having a main body, at least one tab that extends from the main body, at least one slot that is compatible with the at least one tab, and at least one engagement strip within the at least one slot. Additionally, the toy room-building kit comprises a connector component having a main body, at least one slot that is compatible with the building toy component, and at least one engagement strip within the at least one slot. The toy room-building kit also comprises a wall panel that is compatible with the at least one slot of the building toy component and the at least one slot of the connector component. Further, the toy room-building kit comprises an electronic component having wiring that is of a thickness that is able to be integrated with configurations formed using the building toy component, connector component, and wall panel.

These and other features of the present invention will be described in more details below in the detailed description of the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which:

FIG. 23 illustrates a perspective view of a disconnected electronic lightbulb in accordance with embodiments of the present invention.

DETAILED DESCRIPTION OF THE PREFERRED EMBODIMENTS

Figure 1A:
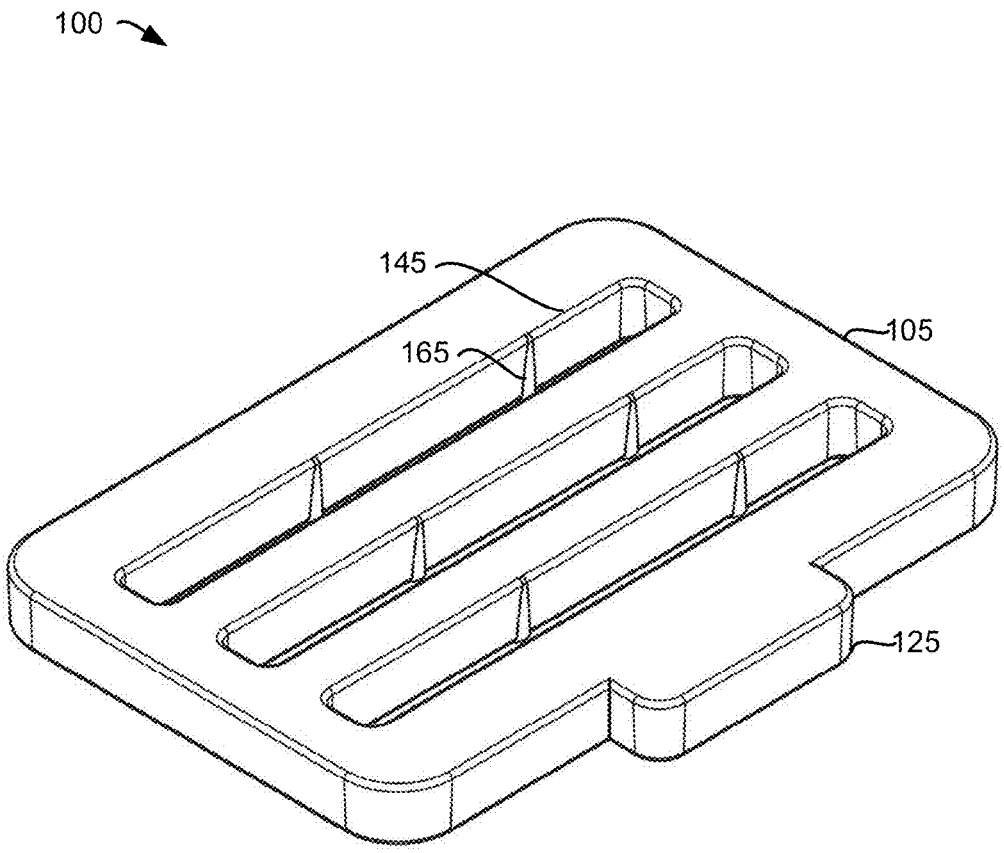
FIGS. 1A-1D illustrate views of a three-slot, centered-tab building toy component in accordance with embodiments of the present invention.

The present disclosure will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

This disclosure provides a toy room-building kit that includes building toy components, connector components, electrical components, and wall paneling. The building toy components, connector components, and wall paneling may be modular, meaning they may be designed with standardized dimensions for easy assembly and maximum flexibility of arrangements in use. In particular, the building toy components, connector components, and wall paneling may be modular both with each other as well as with the other building toy components, connector components, and wall paneling. However, while it is extremely beneficial to have modularity in the components of a toy room-building kit, alternative embodiments may include some components that are not modular, or that are only modular to a limited degree (for example, if some components are compatible with only a portion of other components, such as one side of a component but not another side of the same component) or, as another example, some component may only be modular with a portion of the total number of components.

The wall paneling and connector components may be used to build an outer structure. Further, the building toy components may be used to build furniture pieces. Additionally, the building toy components may be used to decorate an outer structure constructed using the structural components. Further, the building toy components may also be used to build or augment structural components. For example, the building toy components may be used to construct beams, staircases, etc. The use of building toy components for creating and/or augmenting structural components is especially appropriate when all of the components are modular, such as when all of the components are the same thickness.

The building toy components, connector components, and wall paneling may be made out of wood, plastic, cardboard, paper, metal, or other materials. While initial prototypes of the present invention were constructed out of wood, subsequent embodiments have been made out of plastic so as to allow for durability, reapplication of decorative materials, and consistency of product. As such, while wooden building toy components and wall paneling are disclosed herein, and are within the scope of claimed embodiments of the present invention, it is understood that there are benefits of using plastic, such as polypropylene and acrylonitrile butadiene styrene, or other materials instead of wood.

The toy room-building kit may also include electronic components that may be integrated into the building toy components, connector components, and wall paneling. The electronic components may also be modular, both with each other as well as with the building toy components, connector components, and wall paneling. For example, the width of electronic wiring may be designed to fit between building toy components used for joining wall paneling of a miniature room. The electronic components may also be secured by connector components. For example, the wiring of the electronic components may be sandwiched between connector components. The wiring of the electronic components may also be secured to a connector component by passing through a slot of the connector component. Further, electronic components may be secured through an aperture in a building toy component or wall paneling by using a nut or washer lock. The electronic components may also be secured using connector components. As such, electronic components may be used to integrate electricity-based elements into the building toy components, connector components, and wall paneling.

The building toy components, connector components, wall paneling, and electrical components may be combined to construct a fully customizable miniature toy room. Additionally, the miniature toy room may be decorated and redecorated by a user. For example, the miniature toy room may be decorated using stickers, markers, etc. that may be removed and reapplied in different configurations.

Miniature toy rooms that are constructed in accordance with embodiments of the present invention may be flexible, stackable, and attachable. In particular, a user can connect building toy components, connector components, and wall paneling in many ways. In particular, this compatibility is due to the dimensions of the building toy components, connector components, and wall paneling as being compatible with one another. Each piece is "universally" adaptable with each other piece, meaning that there is at least one way in which to engage any one piece with another. Additionally, the rooms that are constructive can be made to have varying dimensions (heights, widths, and lengths) by utilizing connective pieces to connect wall paneling, thus vastly expanding the size of a room. The wall paneling for the rooms can be connected side-by-side, one-on-top-of-another, and built with add-on features such as overhangs and slanted roofs. This can create any structure, such as a house, shopping mall, hotel, store, etc. Additionally, structures can be constructed to include balconies. Further, wall paneling may be flexible—for example, walls of a miniature room can be made out of flexible materials such that they can be bent to make curved walls.

Building toy components may also be completely modular. In particular, each building toy component may be designed to be compatible with every other building toy component and connector component. While this maximizes the number of configurations that may be created, embodiments of the present disclosure also allow for pieces to be one or a discrete number of sizes so as to prevent potential infringers from copying the present disclosure. As such, while embodiments of the present disclosure may be completely compatible, with slots and tabs being within a universal range of thickness across building toy components, connector components and wall paneling, the scope of the present disclosure allows for variance on these aspects in further embodiments.

Building toy components may be used to create items such as chairs, tables, beds, bookshelves, dog houses, stairways, sofas, nightstands, desks, coffee tables, a dish rack, etc. Additionally, electronic components may be integrated into the miniature toy room. For instance, electronic components may be held in place using connector components and/or building toy components. Additionally and/or alternatively, circuits may stand alone. Examples of these types of components are discussed herein in accordance with embodiments of the present disclosure.

FIGS. 1A-1D illustrate views of a three-slot, centered-tab building toy component 100 in accordance with embodiments of the present invention. In particular, FIGS. 1A-1D show main body 105, tab 125, slots 145, and engagement strips 165. Main body 105 has a uniform length 110, width 115, and thickness 120. Additionally, main body 105 has a tab 125 that extends from a side of main body 105. Tab 125 has length 130, width 135, and thickness 140. The tab length 130 and tab thickness 140 are both equal to the main body thickness 120. Further, main body 105 has three slots 145. Each slot 145 has a length 150, width 155, and thickness 160.

Accordingly, FIG. 1A illustrates a top perspective view of the three-slot, centered-tab building toy component 100 in accordance with embodiments of the present invention. As shown in FIG. 1A, main body 105 has a generally rectangular geometry. As such, main body 105 contains slots 145 that are able to engage tabs, such as tab 125, from compatible building toy components.

In order to engage tabs securely, slots 145 include engagement strips 165. Accordingly, FIG. 1A shows that slots 145 within the main body 105 have sidewalls that contain engagement strips 165. When manufactured using an injection molding process, the angle of the slots 145 may be less than 90 degrees so as to ease the removal of components from a mold. For example, the angle of slots 145 may be 88 degrees, as seen in FIG. 1A. Accordingly, engagement strips 165 may be added so as to increase accommodate the 2 degree difference that is due to the formation process. As such, when a compatible tab, such as tab 125, is inserted into slot 145, engagement strips 165 secure the tab into slot 145. Further, the engagement strips are spaced near enough such that at least one engagement strip 165 will engage a compatible tab that is fully inserted into a portion of a slot 145.

Figure 1B:
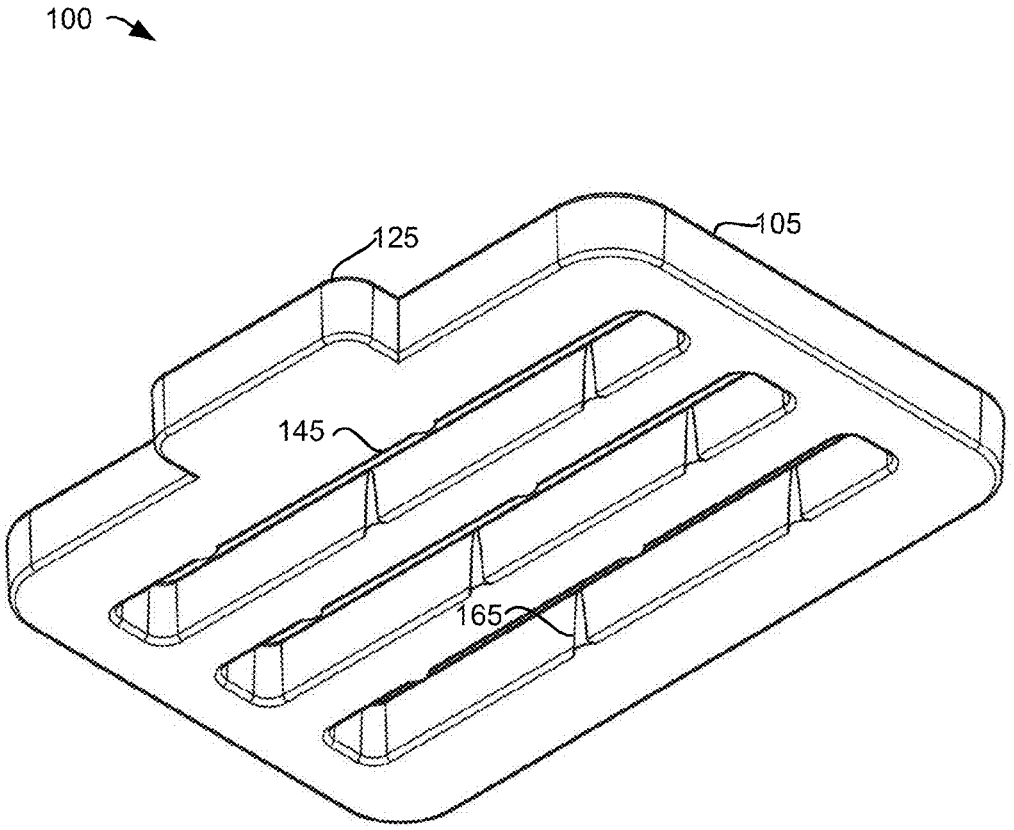

FIG. 1B illustrates a bottom perspective view of the three-slot, centered-tab building toy component 100 in accordance with embodiments of the present invention. Again, in FIG. 1B, engagement strips 165 on the sidewalls of the slots 145 are visible. Further, the base of the engagement strips 165 as seen in FIG. 1B are slightly larger than the tops of the engagement strips as seen in FIG. 1A. As discussed above, this tapering of the engagement strips 165 compensates for the nature of an injection molding process, wherein portions of the injection molding process must be tapered so as to allow for the building toy components to be removed from the injection mold.

Figure 1C:
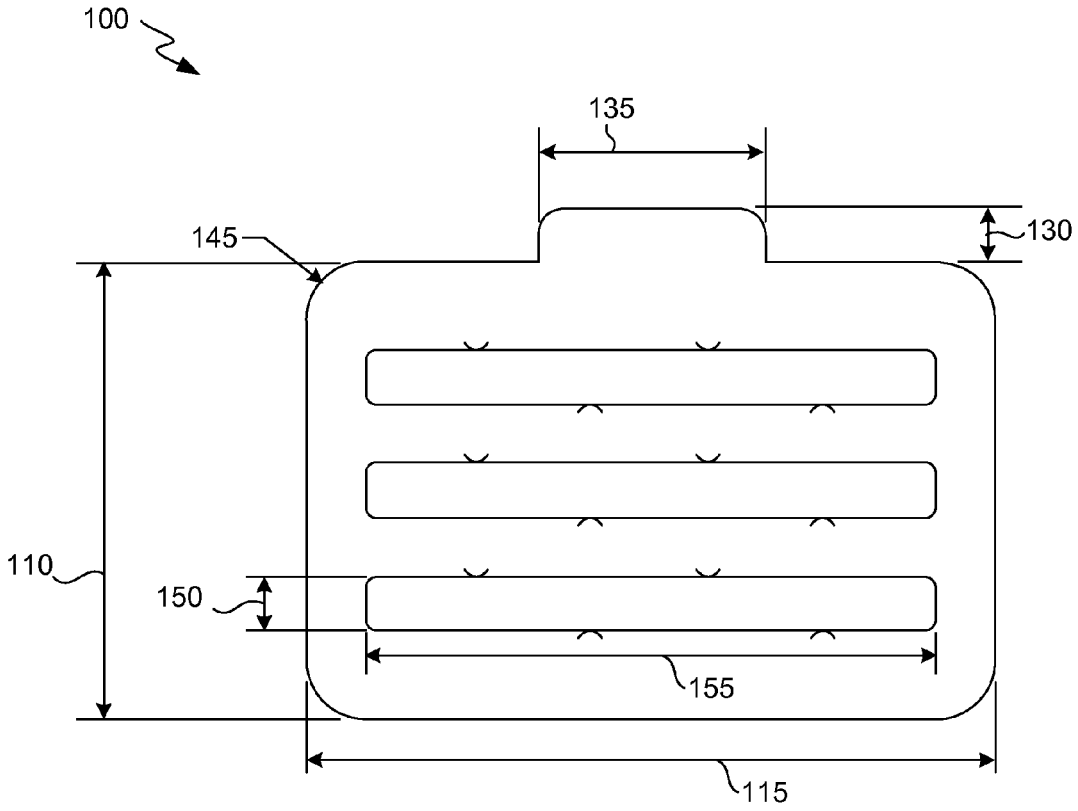

FIG. 1C illustrates a front view of the three-slot, centered-tab building toy component in accordance with embodiments of the present invention. Further, FIG. 1C illustrates dimensions of main body 105 comprising a length 110 of 1.000+/−0.005 inches and a width 115 of 1.500+/−0.005 inches. FIG. 1C also illustrates the dimensions of tab 125 comprising a length 130 of 0.125+/−0.005 inches and a width 130 of 0.500+/−0.003 inches. Additionally, the dimensions of slots 145 comprise a length 150 of 0.125+/−0.003 inches and a width 155 of 1.250+/−0.005 inches.

Figure 1D:
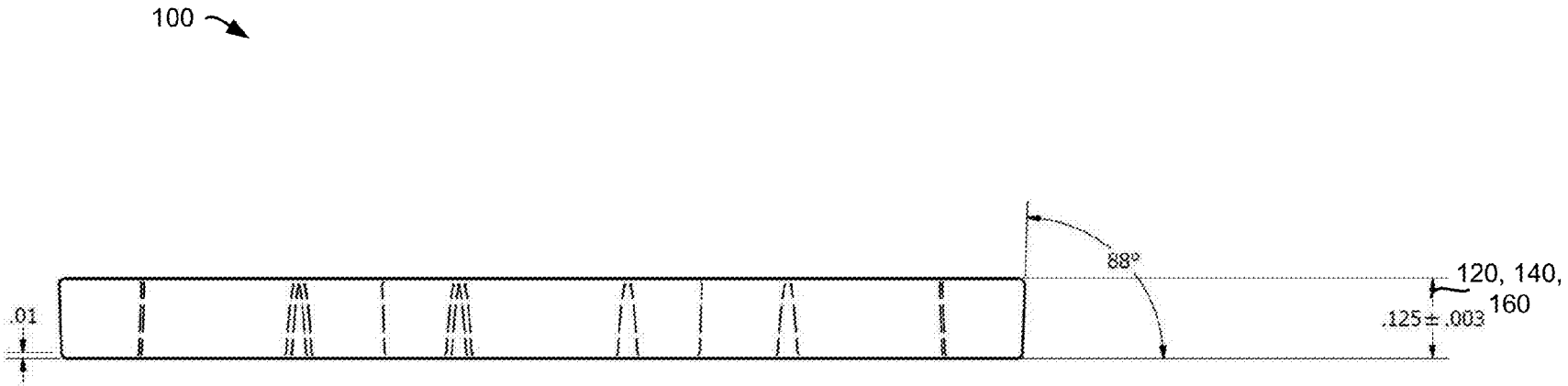

FIG. 1D illustrates a side view of the three-slot, centered-tab building toy component 100 in accordance with embodiments of the present invention. In particular, FIG. 1D illustrates that the thickness of the three-slot, centered-tab building toy component is 0.125+/−0.003 inches. Accordingly, this thickness is constant across main body thickness 120, tab thickness 140, and slot thickness 160. Further, as seen in FIG. 1D, the thickness of component 100 is seen as maintaining a constant thickness across the three-slot, centered-tab building toy component 100.

Figure 2A:
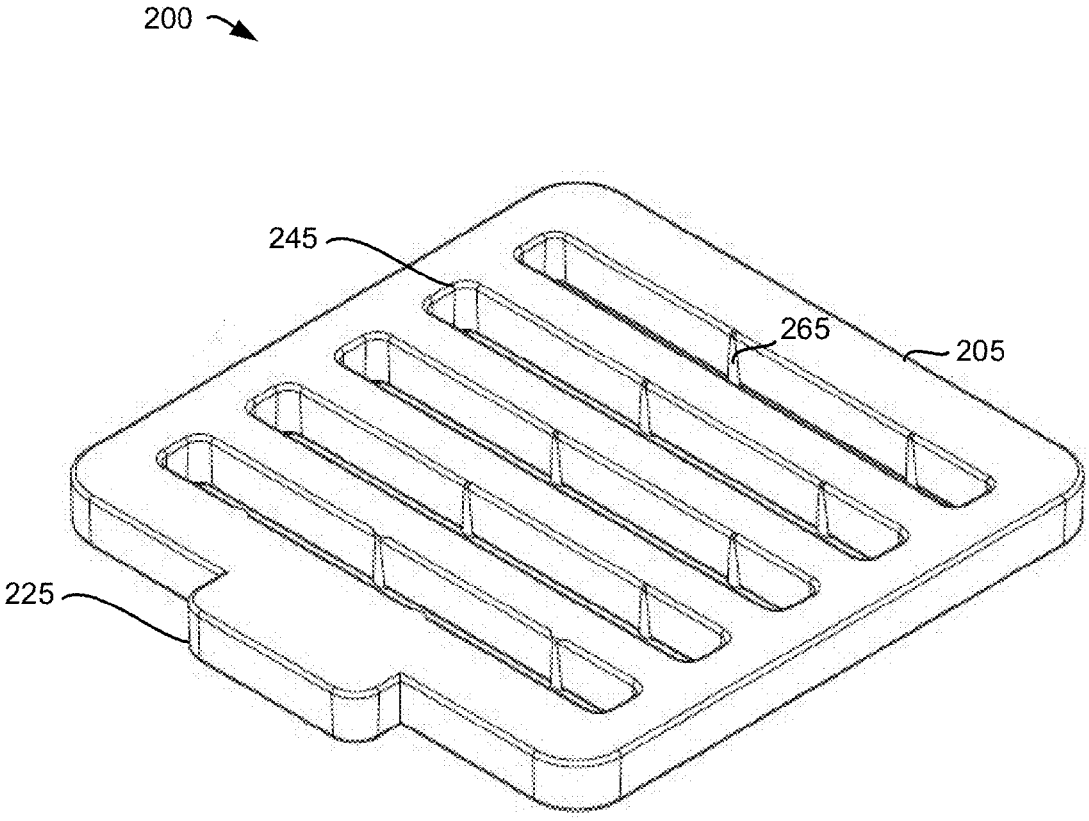
FIGS. 2A-2C illustrate views of a five-slot, centered-tab building toy component in accordance with embodiments of the present invention.
Figure 2B:
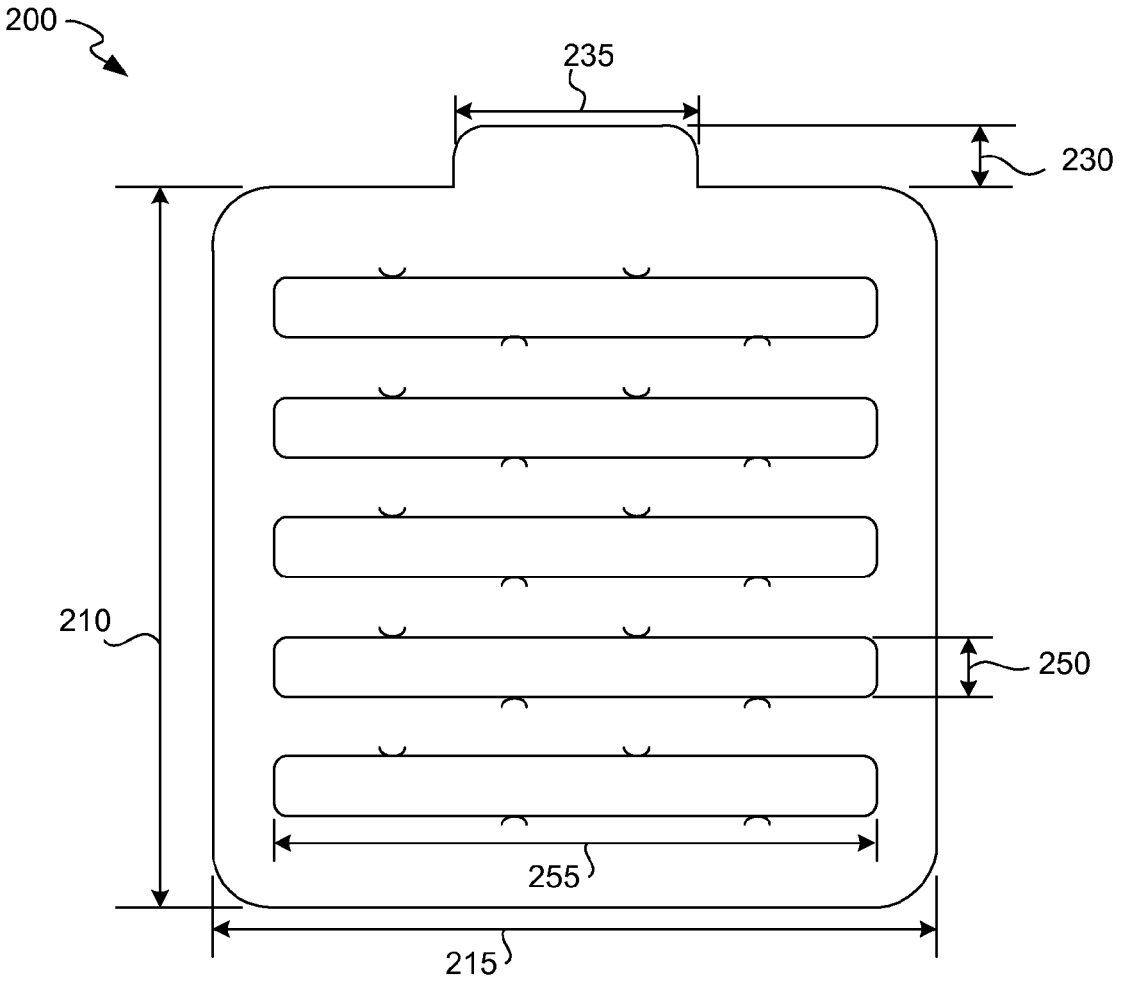
Figure 2C:
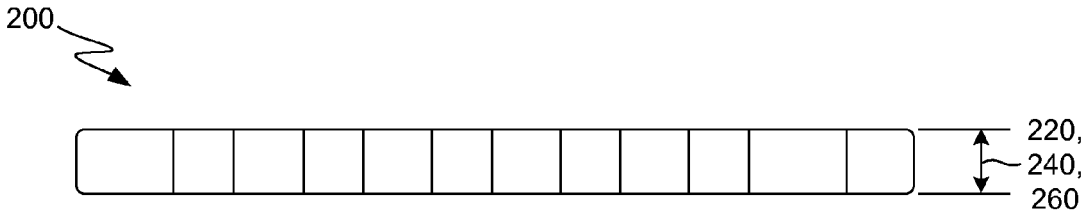

FIGS. 2A-2C illustrate views of a five-slot, centered-tab building toy component 2002 in accordance with embodiments of the present invention. In particular, FIGS. 2A-2C show main body 205, tab 225, slots 245, and engagement strips 265. Main body 205 has a uniform length 210, width 215, and thickness 220. Additionally, main body 205 has a tab 225 that extends from a side of main body 205. Tab 225 has length 230, width 235, and thickness 240. The tab length 230 and tab thickness 240 are both equal to the main body thickness 220. Further, main body 205 has three slots 245. Each slot 245 has a length 250, width 255, and thickness 260.

Accordingly, FIG. 2A illustrates a top perspective view of the five-slot, centered-tab building toy component 200 in accordance with embodiments of the present invention. In particular, FIG. 2A also shows a main body 205 having a generally rectangular geometry. Additionally, FIG. 2A illustrates the use of five slots 245 having tab-engaging strips 265. Accordingly, FIG. 2A shows that slots 245 within the main body 205 have sidewalls that contain engagement strips 265. In particular, the engagement strips 265 are spaced near enough such that at least one engagement strip 265 will engage a compatible tab, such as tab 225, that is fully inserted into a portion of the slot 245.

FIG. 2B illustrates a front view of the five-slot, centered-tab building toy component 200 in accordance with embodiments of the present invention. Further, FIG. 2B illustrates dimensions of main body 205 comprising a length 210 of 1.500+/−0.005 inches, and a width 215 of 1.500+/−0.005 inches. FIG. 2B also shows dimensions of tab 225 comprising a length 230 of 0.125+/−0.005 inches and a width 235 of 0.500+/−0.003 inches. The dimensions of slots 245 comprise a length 250 of 0.125+/−0.003 inches and a width 255 of 1.250+/−0.005 inches.

Further, FIG. 2C illustrates a side view of the five-slot, centered-tab building toy component 220 in accordance with embodiments of the present invention. In particular, FIG. 2C demonstrates dimensions of the five-slot, centered-tab building toy component 200. In particular, FIG. 2C illustrates that the thickness of the five-slot, centered-tab building toy component is 0.125+/−0.003 inches. Accordingly, this thickness is constant across main body thickness 220, tab thickness 240, and slot thickness 260. Further, as seen in FIG. 2C, the thickness of component 200 is seen as maintaining a constant thickness across the five-slot, centered-tab building toy component 200.

Figure 3A:
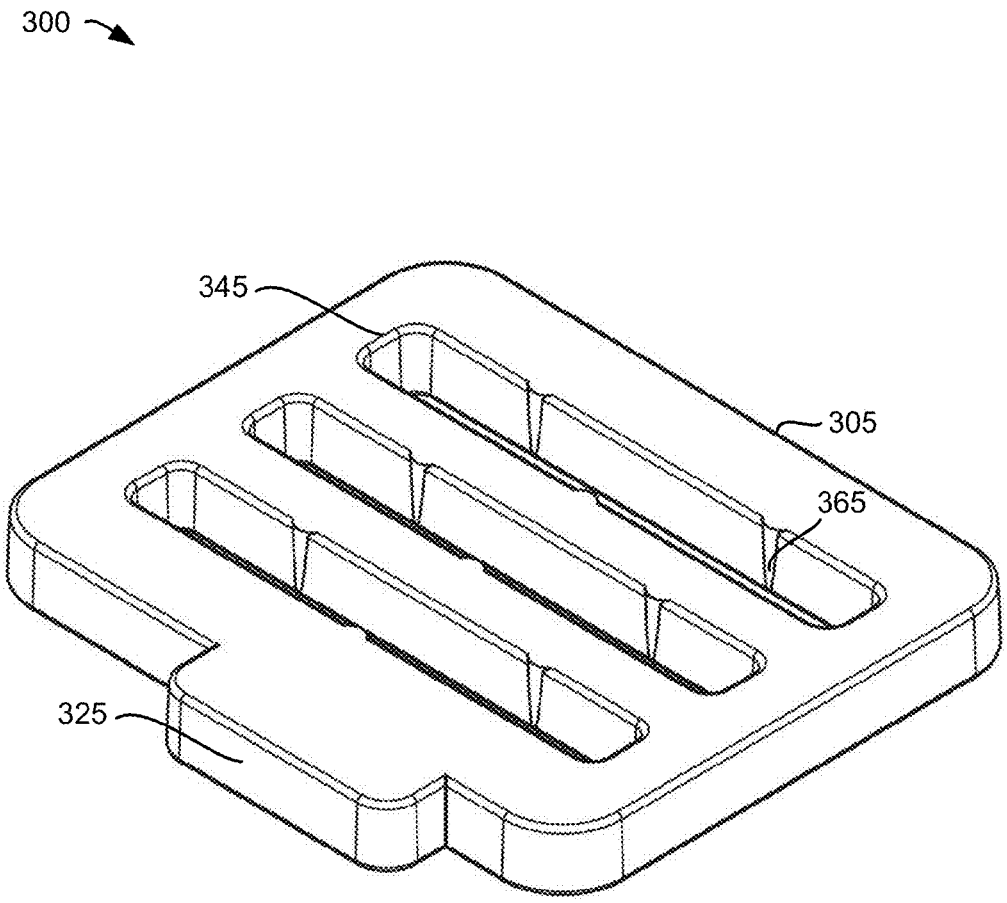
FIGS. 3A-3C illustrate views of a three-slot, skewed-tab building toy component in accordance with embodiments of the present invention.
Figure 3B:
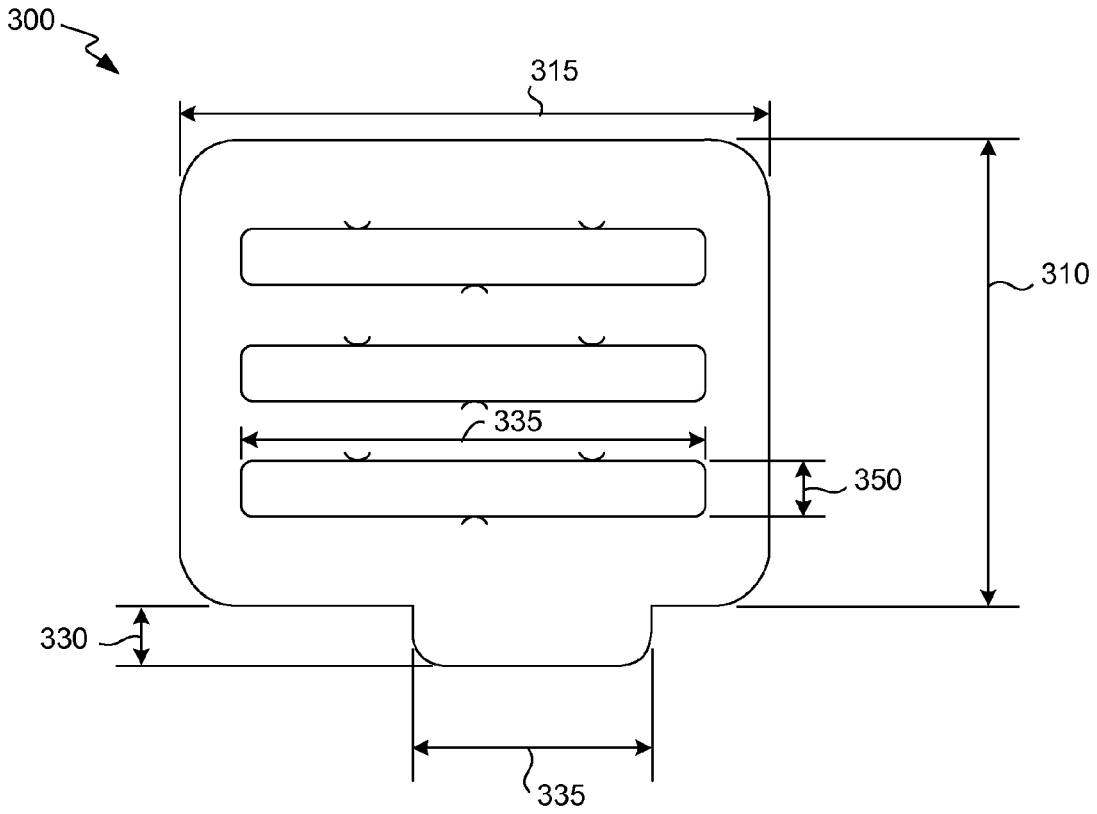
Figure 3C:
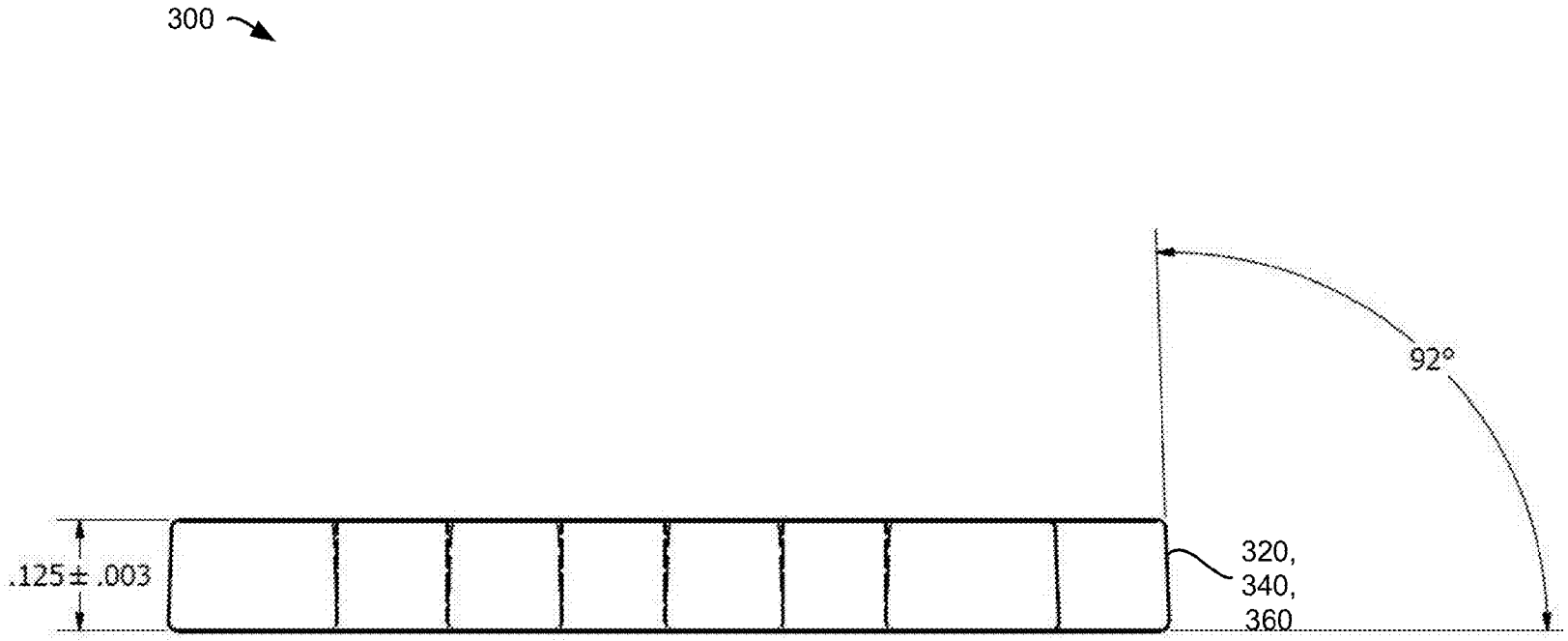

FIGS. 3A-3C illustrate views of a three-slot, skewed-tab building toy component 300 in accordance with embodiments of the present invention. In particular, FIGS. 3A-3C show main body 305, tab 325, slots 345, and engagement strips 365. Main body 305 has a uniform length 310, width 315, and thickness 320. Additionally, main body 305 has a tab 325 that extends from a side of main body 305. Tab 325 has length 330, width 335, and thickness 340. The tab length 330 and tab thickness 340 are both equal to the main body thickness 320. Further, main body 305 has three slots 345. Each slot 345 has a length 350, width 355, and thickness 360.

As such, FIG. 3A illustrates a top perspective view of a three-slot, skewed-tab building toy component 300 in accordance with embodiments of the present invention. In particular, the three-slot skewed-tab building toy component 300 is similar to component 100 as shown in FIG. 1. In both cases, a tab extends through the bottom edge of a main body, and in both cases there are three slots available to receive engaging portions from other components. However, component 300 has a tab that is off-center, while the tab in component 100 is centered. Component 300 also includes engagement strips. FIG. 3A shows the engagement strips within the slots of component 300.

FIG. 3B illustrates a front view of the five-slot, centered-tab building toy component 300 in accordance with embodiments of the present invention. Further, FIG. 3B illustrates dimensions of main body 305 comprising a length 310 of 1.000+/−0.01 inches, and a width 315 of 1.250+/−0.005 inches. The additional dimensions of tab 325 comprise a length 330 of 0.125+/−0.003 inches and a width 335 of 0.500+/−0.003 inches. Further, tab 325 is off-set along the width 315 of main body 305. In particular, the width 335 of tab 325 is adjacent to a width of 0.500+/−0.003 inches and a width of 0.250+/−0.003 inches on either side. As such, tab 325 is askew with respect to the center of width 335 of main body 305. Further, the dimensions of slots 345 comprise a length 350 of 0.125+/−0.003 inches and a width 355 of 1.000+/−0.003 inches.

Further, FIG. 3C illustrates a side view of the three-slot, skewed-tab building toy component 300 in accordance with embodiments of the present invention. In particular, the side view shows additional dimensional aspects of component 300. In particular, FIG. 3C illustrates that the thickness of the three-slot, skewed-tab building toy component is 0.125+/−0.003 inches. Accordingly, this thickness is constant across main body thickness 320, tab thickness 340, and slot thickness 360. Further, as seen in FIG. 3C, the thickness of component 300 is seen as maintaining a constant thickness across the three-slot, centered-tab building toy component 300.

Figure 4A:
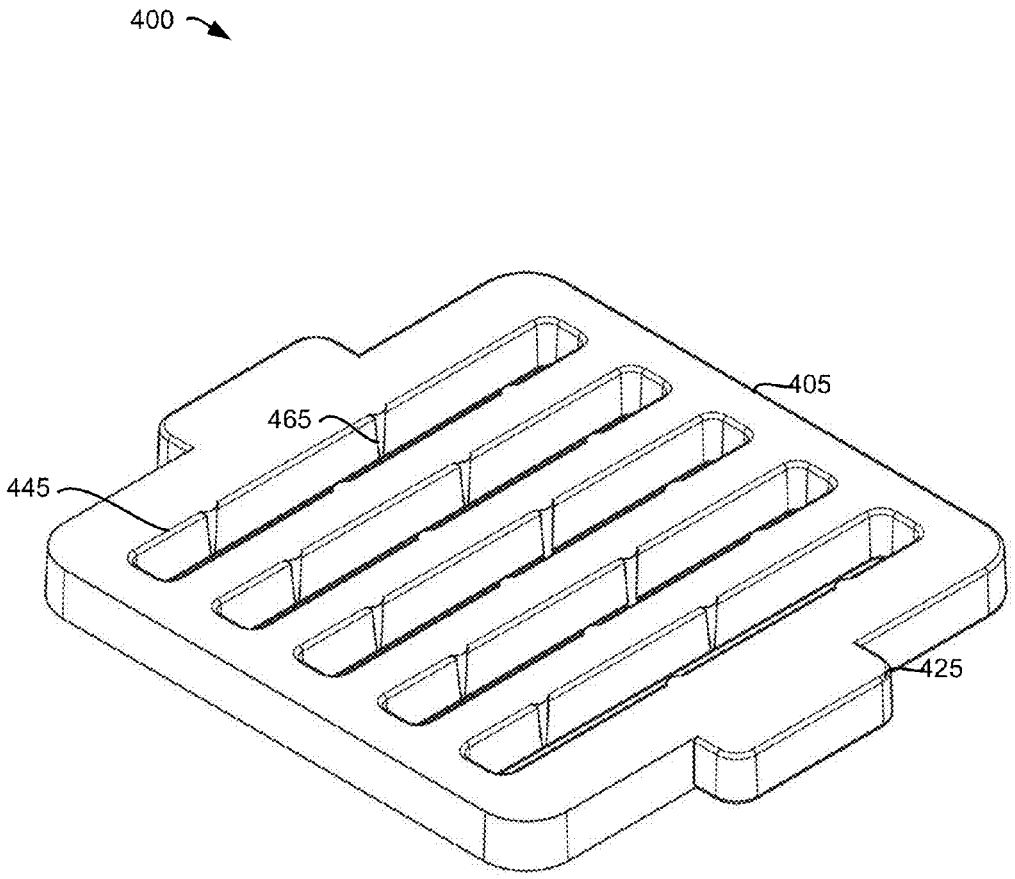
FIGS. 4A-4C illustrate views of a five-slot, double-tab building toy component in accordance with embodiments of the present invention.
Figure 4B:
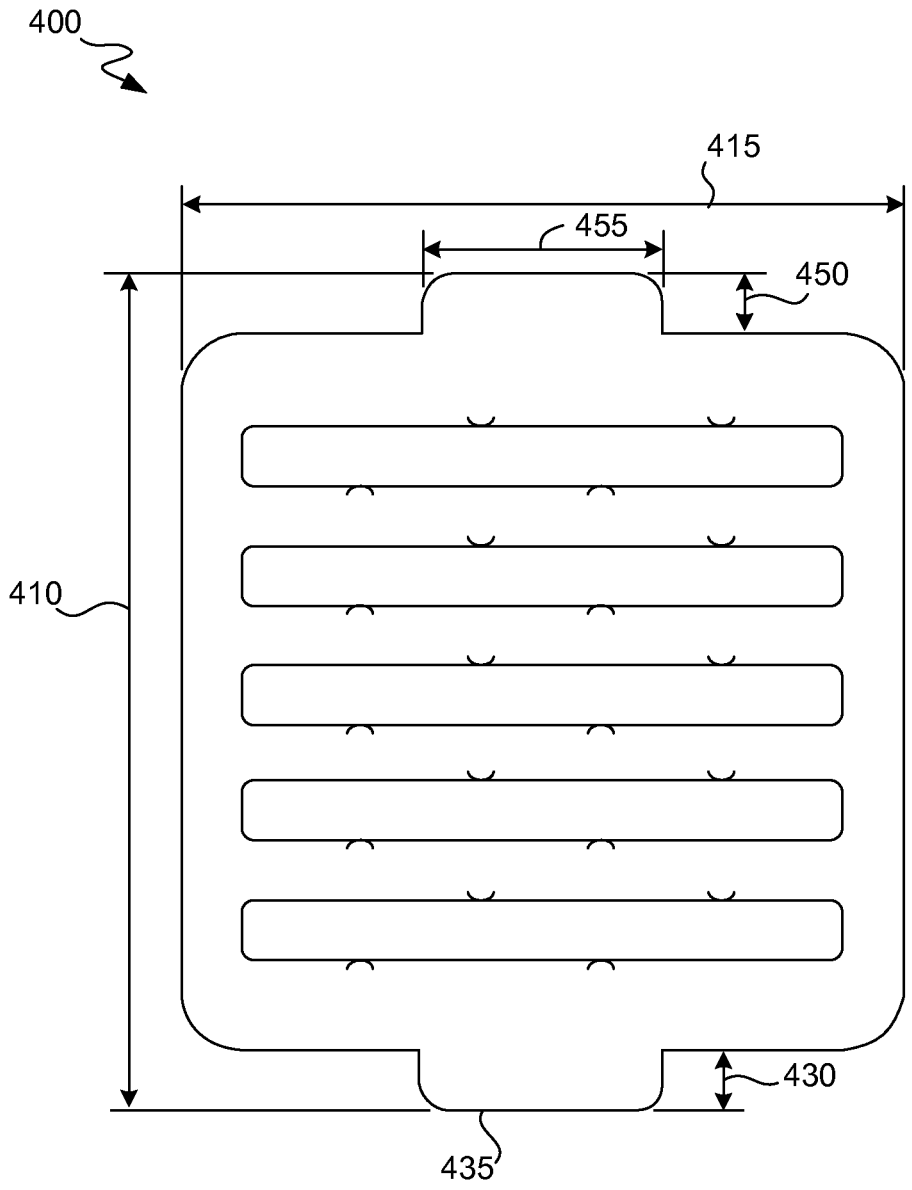
Figure 4C:
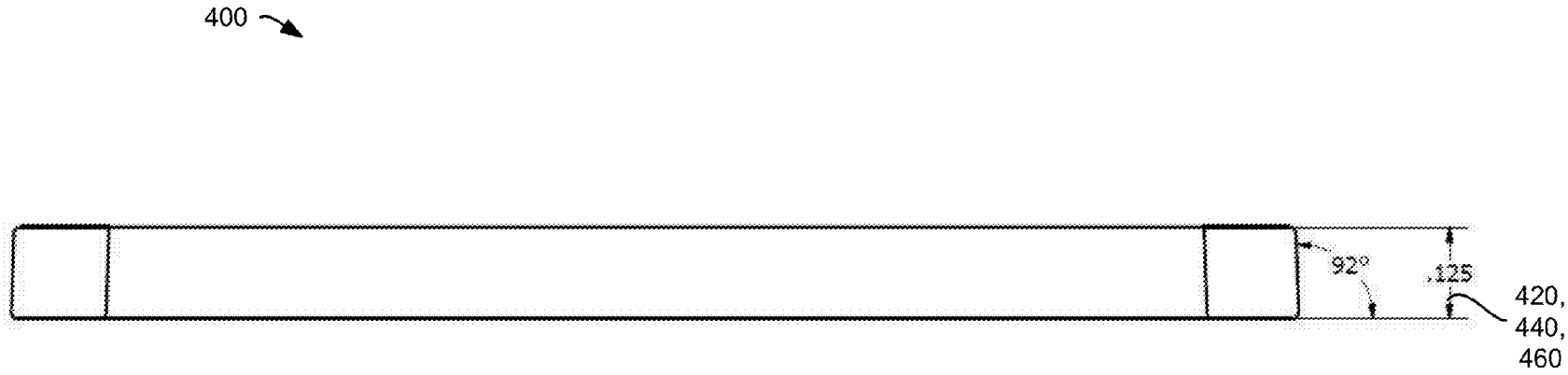

FIGS. 4A-4C illustrate views of a five-slot, double-tab building toy component 400 in accordance with embodiments of the present invention. In particular, FIGS. 4A-4C show main body 405, tabs 425, slots 445, and engagement strips 465. Main body 405 has a uniform length 410, width 415, and thickness 420. Tabs 425 have length 430, width 435, and thickness 440. The dimension of tabs length 430 and tabs thickness 440 are both equal to the main body thickness 420. Further, main body 405 has five slots 445. Each slot 445 has a length 450, width 455, and thickness 460.

Accordingly, FIG. 4A illustrates a top perspective view of the five-slot, double-tab building toy component 400 in accordance with embodiments of the present invention. Component 400 includes a main body 405 that has a generally rectangular geometry. Further, component 400 shows tabs extending through a top edge and a bottom edge of the main body, respectively. The tabs extending from the top edge and bottom edge of the main body 405 are centered, though alternative embodiments may have one or more of the tabs off-center. Component 400 also include engagement strips 465. In particular, each slot 445 has at least one engagement strip 465, which allows the slot to securely interact with compatible tabs or other compatible portions of other building toy components.

FIG. 4B illustrates a front view of the five-slot, double-tab building toy component in accordance with embodiments of the present invention. Further, FIG. 4B illustrates dimensions of main body 405 comprising a length 410 of 1.500+/−0.01 inches, and a width 415 of 1.500+/−0.01 inches. The additional dimensions of tab 425 comprise a length 430 of 0.125+/−0.005 inches and a width 435 of 0.500+/−0.003 inches. Further, the dimensions of slots 445 comprise a length 350 of 0.125+/−0.003 inches and a width 455 of 1.250+/−0.01 inches.

Further, FIG. 4C illustrates a side view of the five-slot, double-tab building toy component in accordance with embodiments of the present invention. In particular, the side view of FIG. 4C shows additional dimensional aspects of component 400. In particular, FIG. 4C illustrates that the thickness of the three-slot, skewed-tab building toy component is 0.125++/−0.003 inches. Accordingly, this thickness is constant across main body thickness 420, tab thickness 440, and slot thickness 460. Further, as seen in FIG. 4C, the thickness of component 400 is seen as maintaining a constant thickness across the three-slot, centered-tab building toy component 400.

Figure 5A:
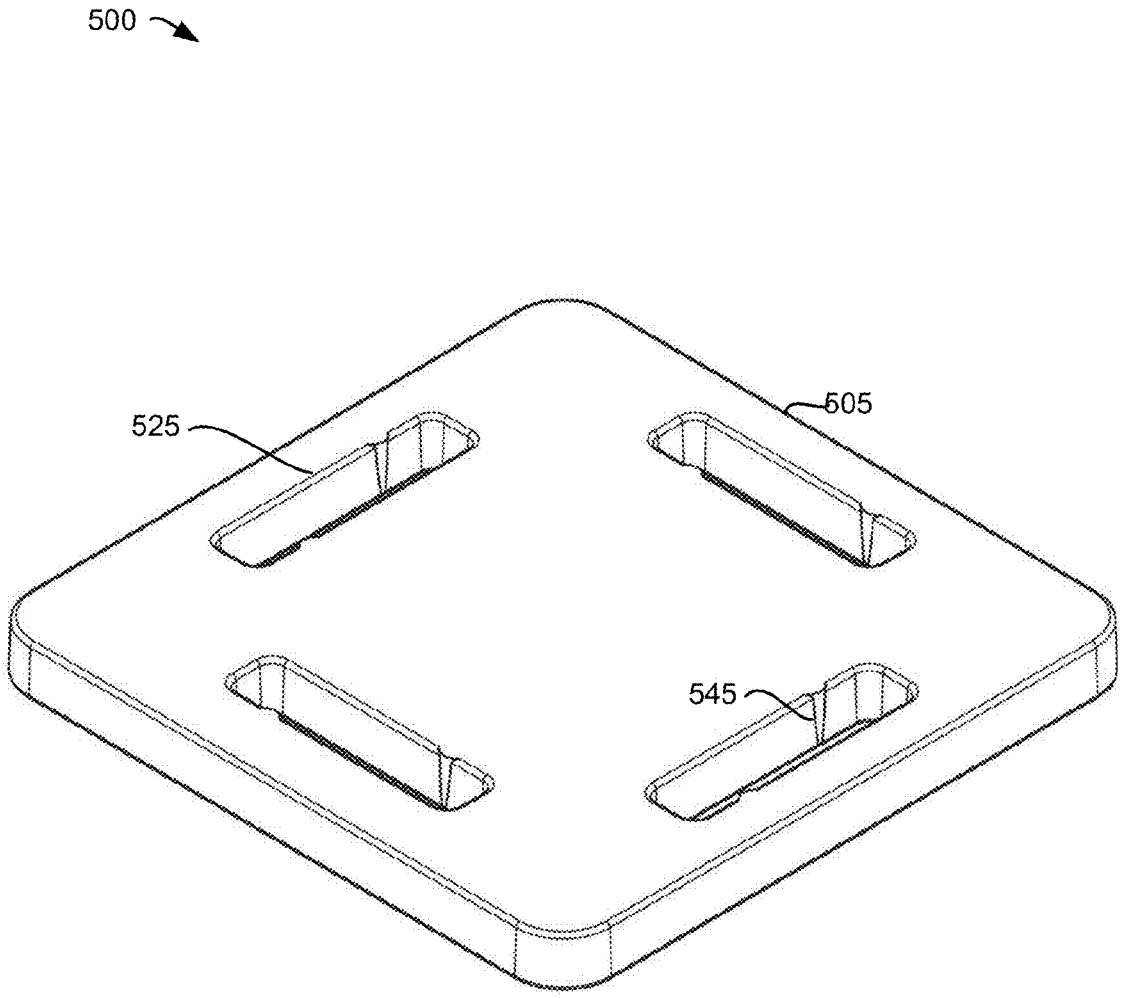
FIGS. 5A-5C illustrate views of a four-slot building toy component in accordance with embodiments of the present invention.
Figure 5B:
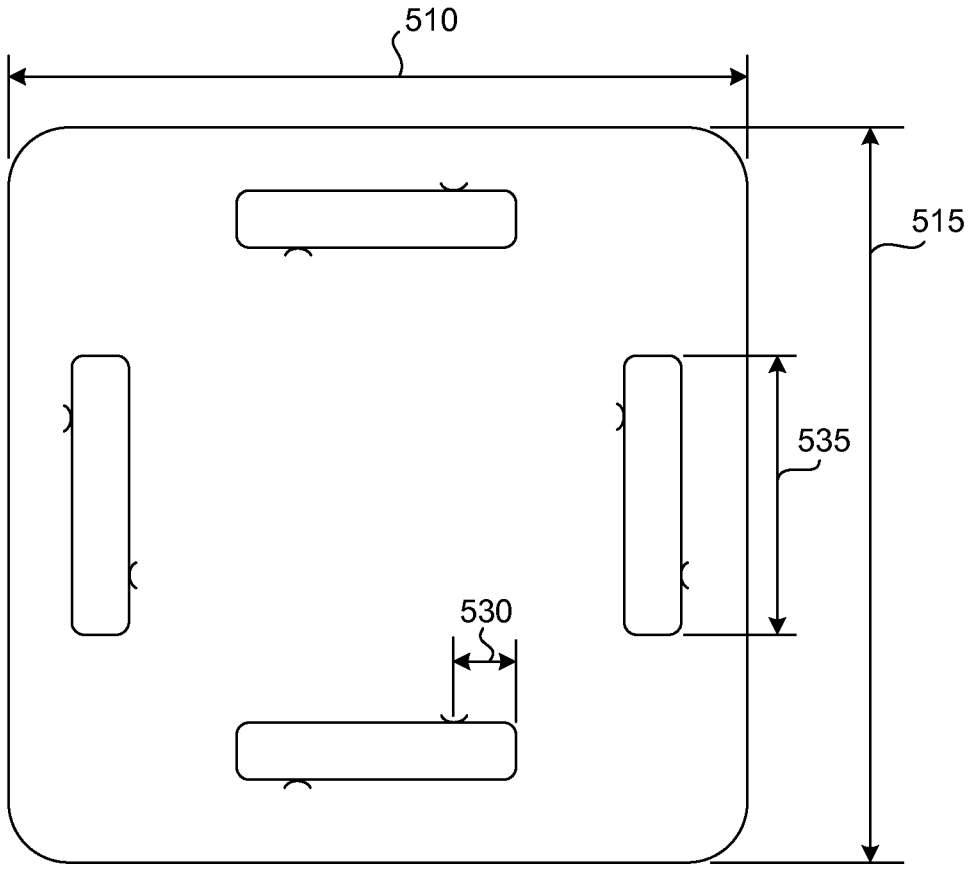
Figure 5C:
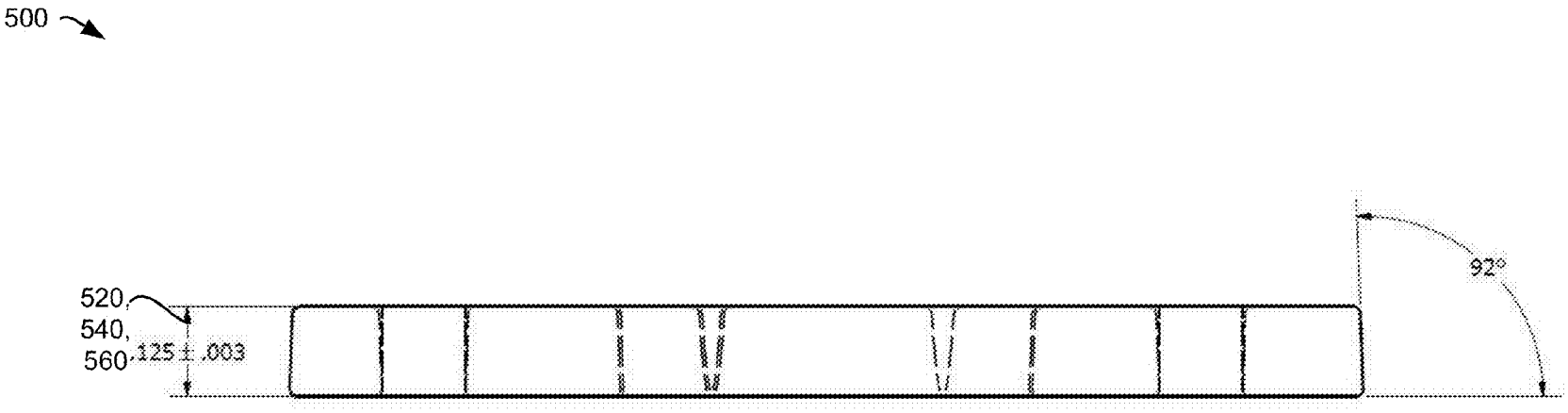

FIGS. 5A-5C illustrate views of a four-slot building toy component in accordance with embodiments of the present invention. As seen in FIGS. 5A-5C, the four-slot building toy component 500 consists of a main body 505 having a generally square geometry. In particular, FIGS. 5A-5C show main body 505 and slots 525. Main body 505 has a uniform length 510, width 515, and thickness 520. Further, main body 505 has four slots 525. Each slot 525 has a length 530, width 535, thickness 540, and engagement strips 565.

As such, FIG. 5A illustrates a top perspective view of a four-slot building toy component 500 in accordance with embodiments of the present invention. Further, component 500 includes a slot 525 that extends along each side of the main body 505. This allows component 500 to engage tabs, such as tab 425 from FIG. 4, from any or all of four orientations. As shown, each slot 525 of component 500 is generally perpendicular to its adjacent slots.

FIG. 5B illustrates a front view of the four-slot building toy component in accordance with embodiments of the present invention. Further, FIG. 5B illustrates dimensions of main body 505 comprising a length 510 of 1.500+/−0.005 inches, and a width 515 of 1.500+/−0.005 inches. Further, the dimensions of slots 525 comprise a length 530 of 0.125+/−0.005 inches and a width 535 of 0.575+/−0.005 inches.

Further, FIG. 5C illustrates a side view of the four-slot building toy component in accordance with embodiments of the present invention. In particular, FIG. 5C illustrates that the thickness of four-slot building toy component 500 is 0.125+/−0.003 inches. Accordingly, this thickness is constant across main body thickness 520 and slot thickness 540. Further, as seen in FIG. 5C, the thickness of four-slot building toy component 500 is seen as maintaining a constant thickness across four-slot building toy component 500.

FIGS. 6A-6D illustrate views of an eight-slot and ten-slot building toy component in accordance with embodiments of the present invention. In particular, FIGS. 6A-6D show main body 605 and slots 625. Main body 605 has a uniform length 610, width 615, and thickness 620. Further, main body 605 has eight or ten slots 625. Each slot 625 has a length 630, width 635, thickness 640, and engagement strips 645.

Figure 6A:
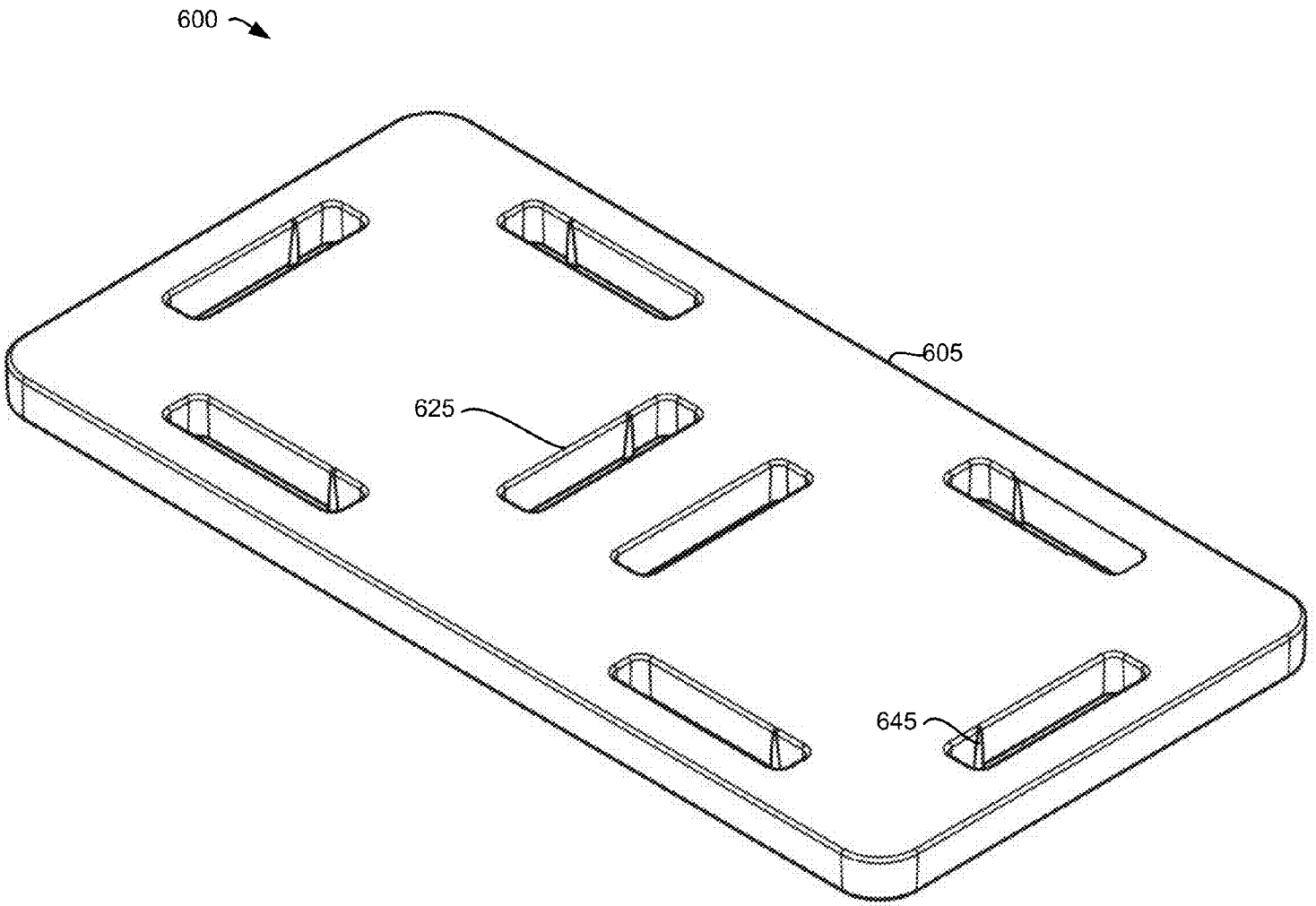
FIGS. 6A-6D illustrate views of an eight-slot building toy component in accordance with embodiments of the present invention.

FIG. 6A illustrates a top perspective view of an eight-slot building toy component 600 in accordance with embodiments of the present invention. As such, FIG. 6A is similar to that of FIG. 5A except that component 600 of FIG. 6A is essentially twice the length of component 500 of FIG. 5A. Both components 500 and 600 consist of main bodies 505 and 605, respectively, having generally right angles as corner and are without tabs that extend from the edge of their main body. Additionally, FIG. 6A also illustrates engagement strips 645 within slots 625. The engagement strips 645 within the slots 625 are able to secure tabs and other interactive parts of other components.

Figure 6B:
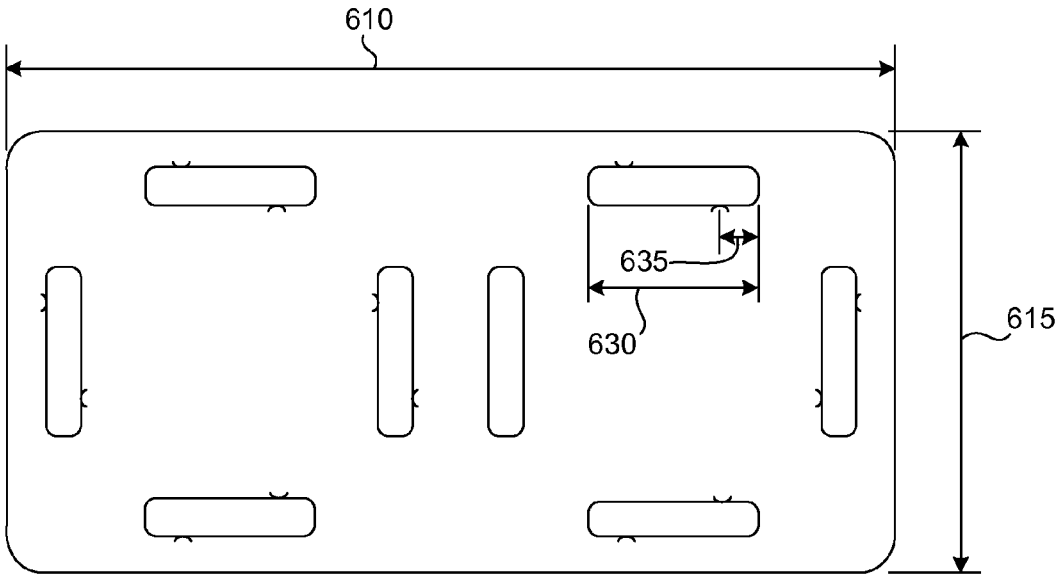

FIG. 6B illustrates a front view of the eight-slot building toy component 600 in accordance with embodiments of the present invention. Further, FIG. 6B illustrates dimensions of main body 605 comprising a length 610 of 1.500+/−0.005 inches, and a width 615 of 3.00+/−0.01 inches. Further, the dimensions of slots 625 comprise a length 630 of 0.125+/−0.005 inches and a width 635 of 0.575+/−0.005 inches.

Figure 6C:
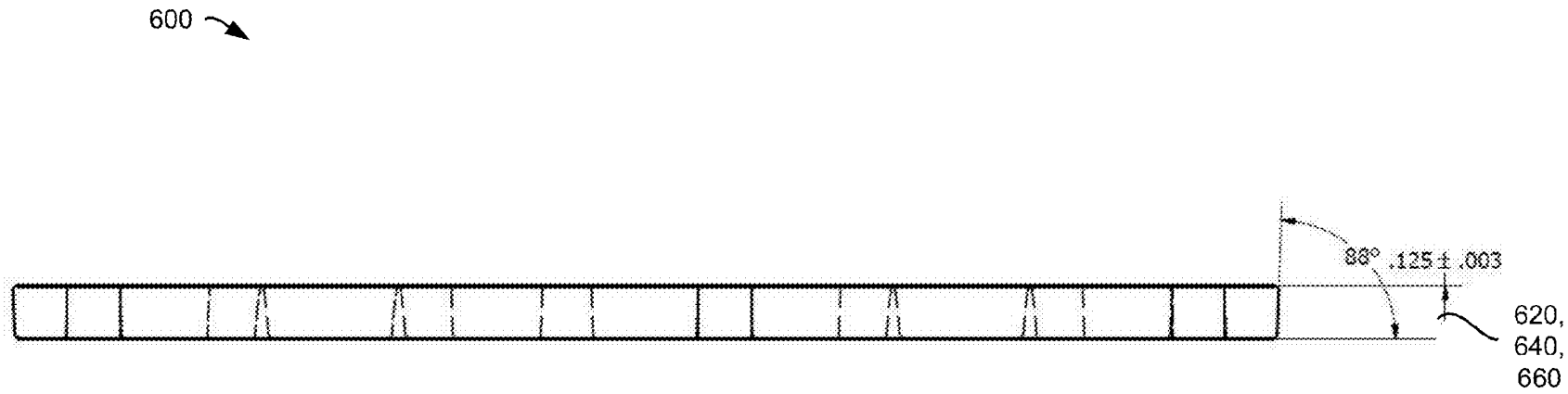

Further, FIG. 6C illustrates a side view of the eight- or ten-slot building toy component 600 or 650 in accordance with embodiments of the present invention. In particular, FIG. 6C illustrates that the thickness of eight- or ten-slot building toy component 600 or 650 is 0.125+/−0.003 inches. Accordingly, this thickness is constant across main body thickness 620 and slot thickness 640. Further, as seen in FIG. 6C, the thickness of eight- or ten-slot building toy component 600 or 650 is seen as maintaining a constant thickness across eight- or ten-slot building toy component 600 or 650.

Figure 6D:
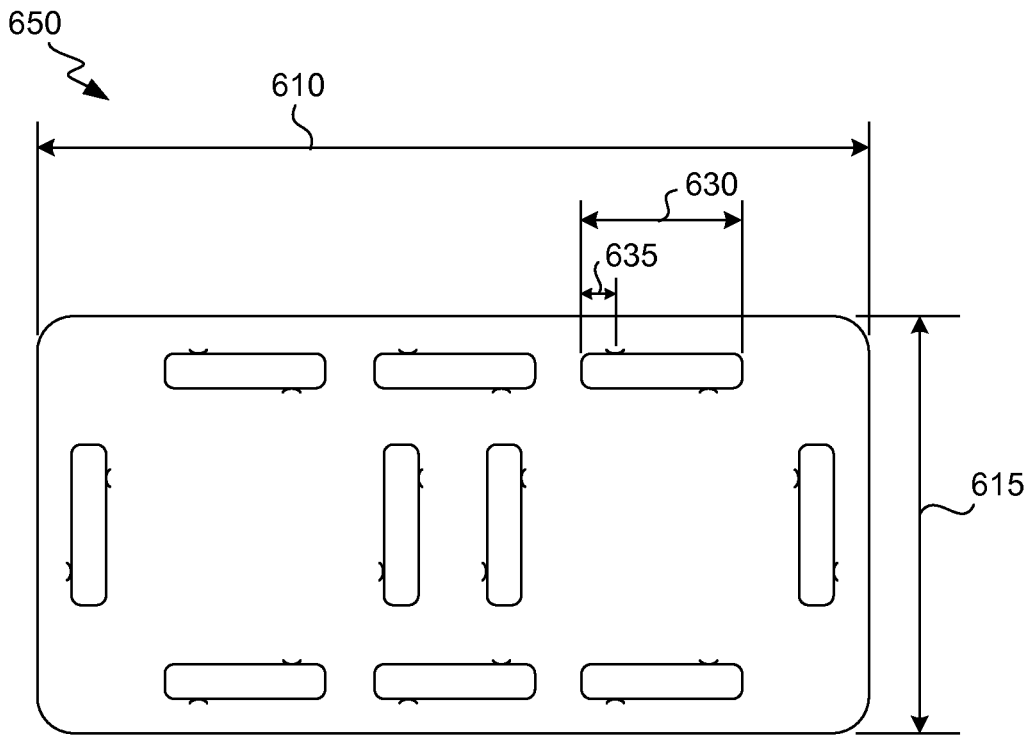

Additionally, FIG. 6D illustrates a front view of the ten-slot building toy component 650 in accordance with embodiments of the present invention. FIG. 6D is similar to FIG. 6A, given that the only differences between FIG. 6D and FIG. 6A are due to the increased number of slots. In other dimensional aspects, FIG. 6D matches FIG. 6A, and is compatible with similar building toy components as FIG. 6A. Further, FIG. 6D illustrates dimensions of main body 605 comprising a length 610 of 1.500+/−0.005 inches, and a width 615 of 3.00+/−0.01 inches. Further, the dimensions of slots 625 comprise a length 630 of 0.125+/−0.005 inches and a width 635 of 0.575+/−0.005 inches.

As discussed above, building toy components may interact with one another through the use of slots and tabs. Additionally, building toy components may be connected through the use of connector components. As such, FIGS. 7A-7D illustrate views of a circular connector component in accordance with embodiments of the present invention. In particular, FIGS. 7A-7D show main body 705 and slots 725. Main body 705 has a uniform radius 710, and thickness 720. Further, main body 705 has eight or ten slots 725. Each slot 725 has a length 730, width 735, thickness 740, and engagement strips 745.

Figure 7A:
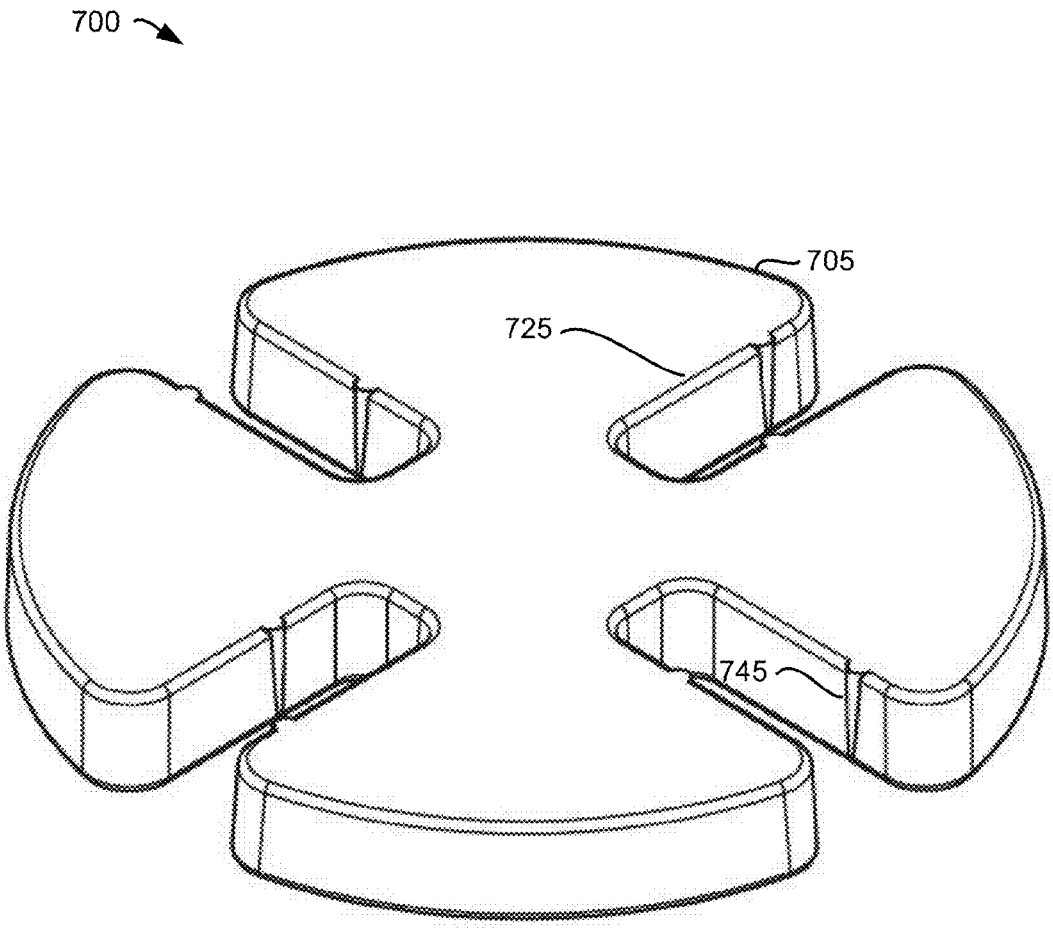
FIGS. 7A-7D illustrate views of a circular connector component in accordance with embodiments of the present invention.

FIG. 7A illustrates a top perspective view of a circular connector component 700 in accordance with embodiments of the present invention. In particular, connector component 700 is formed from a main body 705 that has a generally circular geometry. Further, connector component 700 includes slots 725 that open onto the edge of the circular component 705. These slots may be used to connect building toy components, such as building toy components 100-600. Additionally, connector component 700 also includes engagement strips 745. As with engagement strips of building toy components, the engagement strips 745 of the connector component 700 are tapered generally perpendicularly to the length of each slot.

Figure 7B:
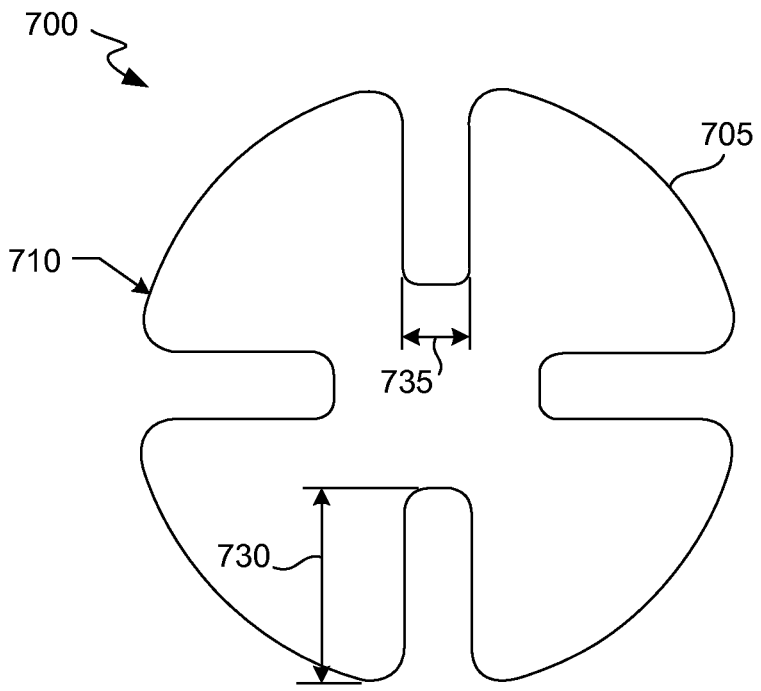

FIG. 7B illustrates a front view of a circular connector component 700 in accordance with embodiments of the present invention. Further, FIG. 7B illustrates dimensions of main body 705 comprising a length of approximately 1.250+/−0.005 inches, and a width of 1.250+/−0.005 inches. In particular, the radius 710 of circular connector component 700 is 0.562+/−0.005 inches. Further, the dimensions of slots 725 comprise a length 730 of 0.375+/−0.005 inches and a width 635 of 0.125+/−0.005 inches.

Figure 7C:
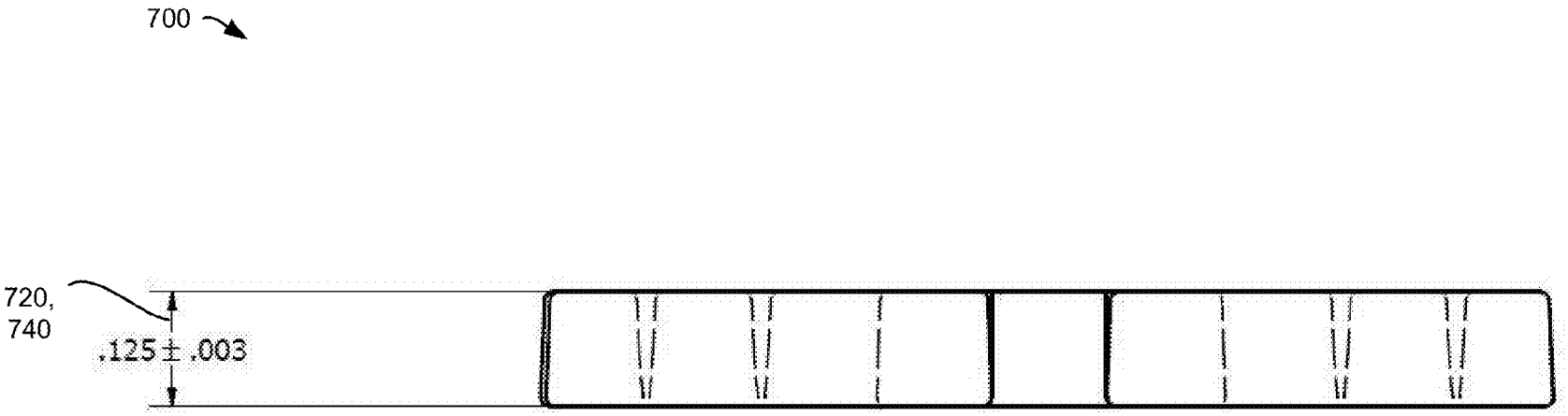

Further, FIG. 7C illustrates a side view of circular connector component 700 in accordance with embodiments of the present invention. In particular, FIG. 7C illustrates that the thickness of circular connector component 700 is 0.125+/−0.003 inches. Accordingly, this thickness is constant across main body thickness 720 and slot thickness 740. Further, as seen in FIG. 7C, the thickness of circular connector component 700 is seen as maintaining a constant thickness across circular connector component 700.

Figure 7D:
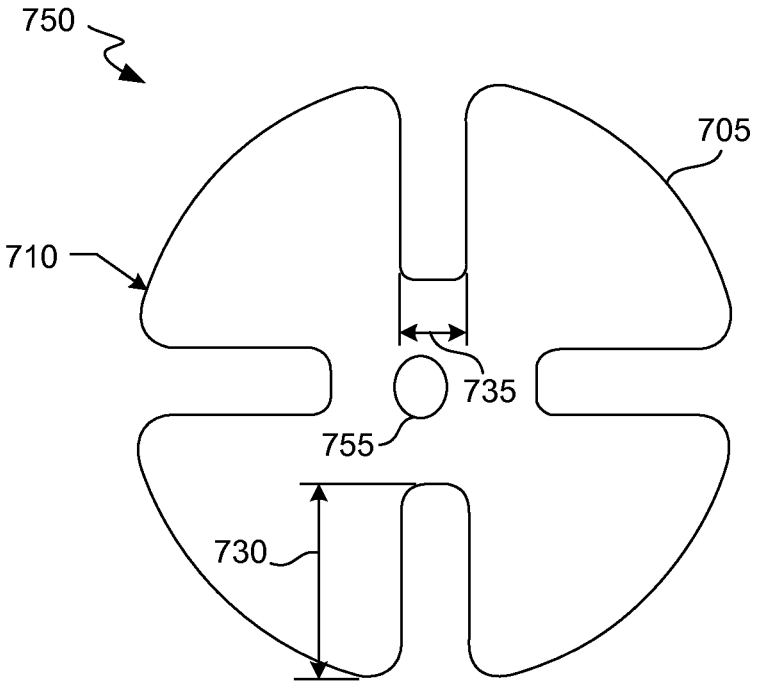

Additionally, a circular connector component may be used to attach to a motor. In this case, a holed circular connector component 750 includes a support hole 755 to attach to a motor. As such, FIG. 7D illustrates a front view 750 of a holed circular connector component 750. While the holed circular connector component 750 is shown as having a circular hole 755, alternative embodiments may disclose another form of attachment.

Figure 8:
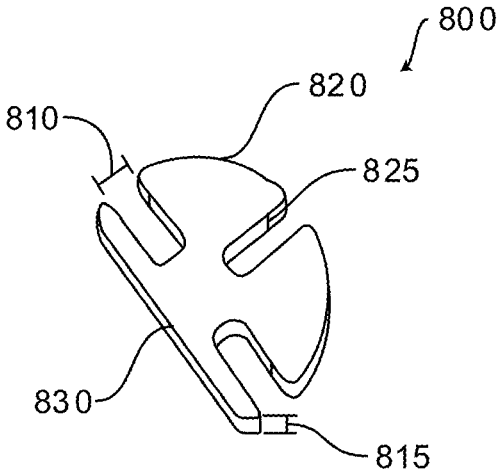
FIG. 8 illustrates a perspective view of a semi-circular connector component in accordance with embodiments of the present invention.

FIG. 8 illustrates a perspective view of a semi-circular connector component 800 in accordance with embodiments of the present invention. In particular, FIG. 8 shows that semi-circular component 800 is generally a portion of a circular connector component such as component 700. However, semi-circular connector component 800 has three slots 810 that are generally perpendicular to at least one adjacent slot, as well as a base component 820 to provide structure to the peripheral slots.

Figure 9:
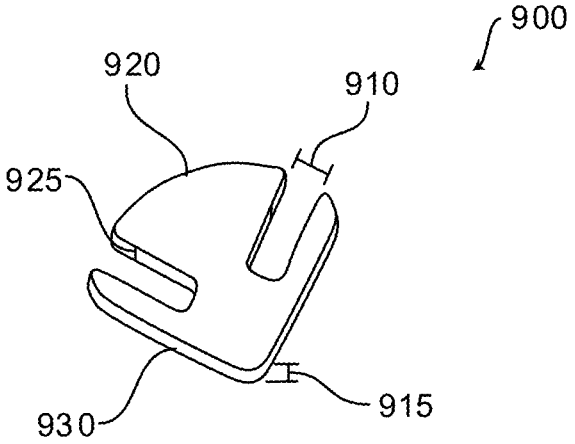
FIG. 9 illustrates a perspective view of a quarter-circular connector component in accordance with embodiments of the present invention.

FIG. 9 illustrates a perspective view of a quarter-circular connector component 900 in accordance with embodiments of the present invention. In particular, FIG. 9 shows that quarter-circular component 900 is generally a portion of a circular connector component such as component 700. However, quarter-circular connector component 900 has two slots 910 that are generally perpendicular to its adjacent slot, as well as a base component 920 to provide structure to the peripheral slots.

Figure 10:
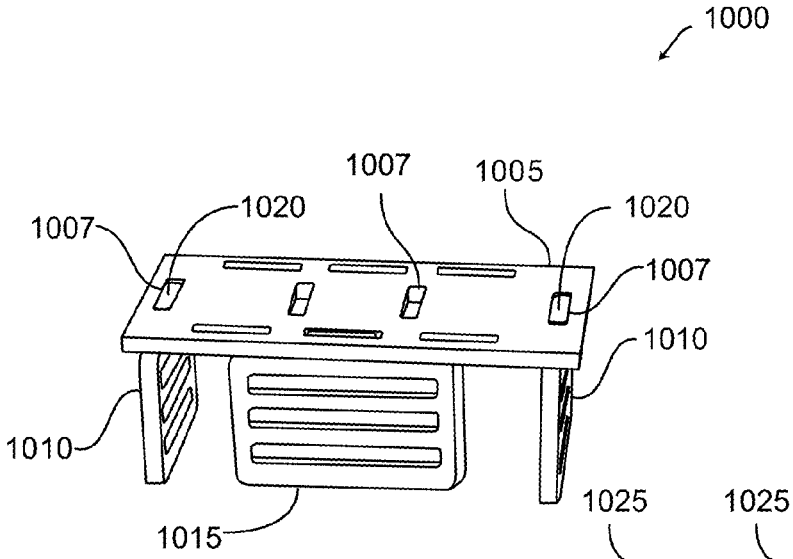
FIG. 10 illustrates a top perspective view of a bench base formed from building toy components in accordance with embodiments of the present invention.

FIG. 10 illustrates a top perspective view of a bench base 1000 formed from building toy components in accordance with embodiments of the present invention. Bench base 1000 is formed by connecting three-slot, centered-tab building toy components into a ten-slot building toy component 1005. Ten-slot building toy component 1005 includes slots 1007. In particular, two three-slot, centered-tab building toy components 1010 are connected at the ends of ten-slot building toy component 1005 and an additional three-slot, centered-tab building toy component 1015 is attached to a center slot of ten-slot building toy component 1005. Further, each of three-slot centered-tab building toy components 1010 and 1015 are oriented below the ten-slot building toy component 1005.

As shown in FIG. 10, tab 1020 of three-slot centered-tab building toy component 1010 is inserted into slot 1007 of ten-slot building toy component 1005. In particular, the top of tab 1020 is in the same plane as the top of ten-slot building toy component 1005. As such, the length of tab 1020 equals the thickness of ten-slot building toy component 1005.

Figure 11:
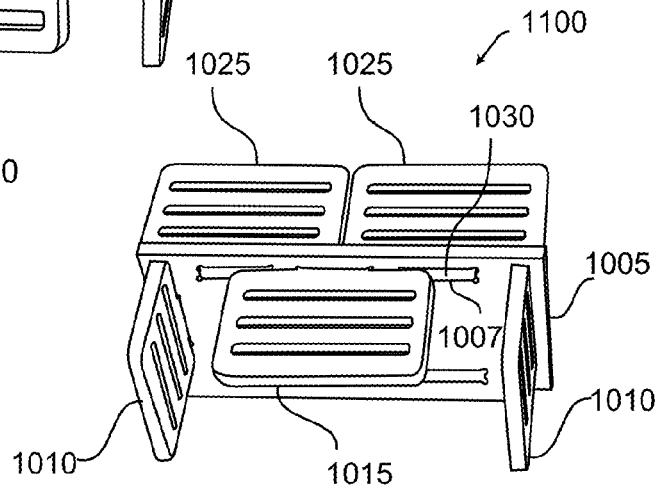
FIG. 11 illustrates a bottom perspective view of a bench formed from a bench base as shown in FIG. 10 in accordance with embodiments of the present invention.

FIG. 11 illustrates a bottom perspective view of a bench 1000 formed from bench base 1000 as shown in FIG. 10 in accordance with embodiments of the present invention. In particular, two three-slot, centered-tab building toy components 1025 are inserted into slots 1007 of bench base 1000 as shown in FIG. 10. As shown in FIG. 11, the tops of tabs 1030 of three-slot centered-tab building toy components 1025 are inserted into slots 1007. Further, the tops of tabs 1030 are flush with the bottom of ten-slot building toy component 1005, so that the body of three-slot building toy component 1015 is not obstructed by the insertion of three-slot centered-tab building toy components 1025 into slots 1007.

Figure 12:
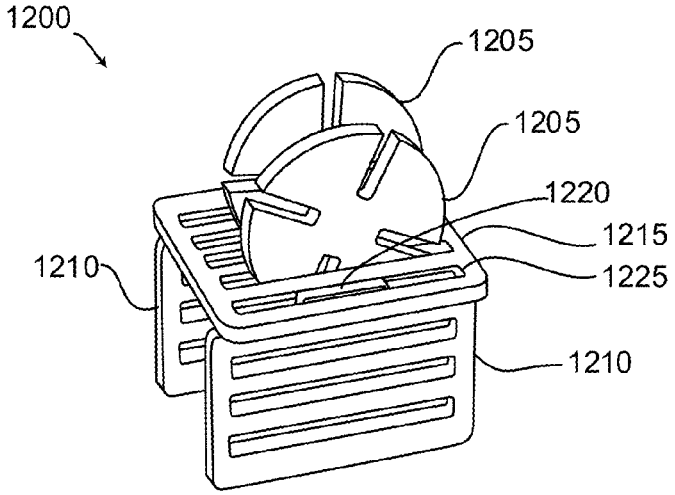
FIG. 12 illustrates a top perspective view of a dishrack formed from building toy components in accordance with embodiments of the present invention.

FIG. 12 illustrates a top perspective view of a dish rack 1200 formed from building toy components in accordance with embodiments of the present invention. As shown in FIG. 12, circular connector components 1205 are engaging with slots 1225 of five-slot, centered-tab building toy component 1215. In particular, portions of components 1205 are placed within slots 1225 of five-slot, centered-tab building toy component 1215. Further, the engagement strips (not shown) of five-slot, centered-tab building toy component 1215 engages the portions of components 1205 that extend into the slots 1225 of five-slot, centered-tab building toy component 1215.

Further, three-slot centered-tab building toy components 1210 are also engaged in slots 1225 of five-slot centered-tab building toy component 1215. In particular, tab 1220 of three-slot, centered-tab building toy component 1210 is inserted into slot 1225 of five-slot, centered-tab building toy component 1215.

Figure 13:
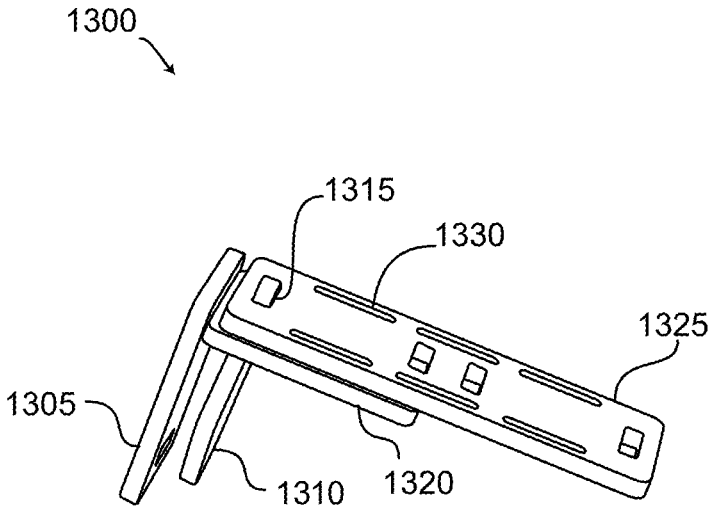
FIG. 13 illustrates a side perspective view of a complex figure formed from building toy components in accordance with embodiments of the present invention.

FIG. 13 illustrates a side perspective view of a complex FIG. 1300 formed from building toy components in accordance with embodiments of the present invention. In particular, FIG. 13 shows the use of corner tabs engaging with slots. As such, FIG. 13 includes a two-slot component 1305, a four-slot component 1310 that has corner 1315, four-slot component 1320, and ten-slot component 1325 that has slots 1330. As seen in FIG. 13, corner 1315 of four-slot component 1310 has passed through a slot (not shown) of four-slot component 1320 as well as slot 1330 of ten-slot component 1325.

Accordingly, FIG. 13 demonstrates that non-tab portions of a building toy component may pass through and engage slots. In particular, the non-tab components may be securely inserted into slots of building toy components when the thickness of building toy components is compatible with the thickness of the slots. This is shown in FIG. 13 as corner 1315 of four-slot building toy component 1310 is secured to two building toy component through slots.

Figure 14:
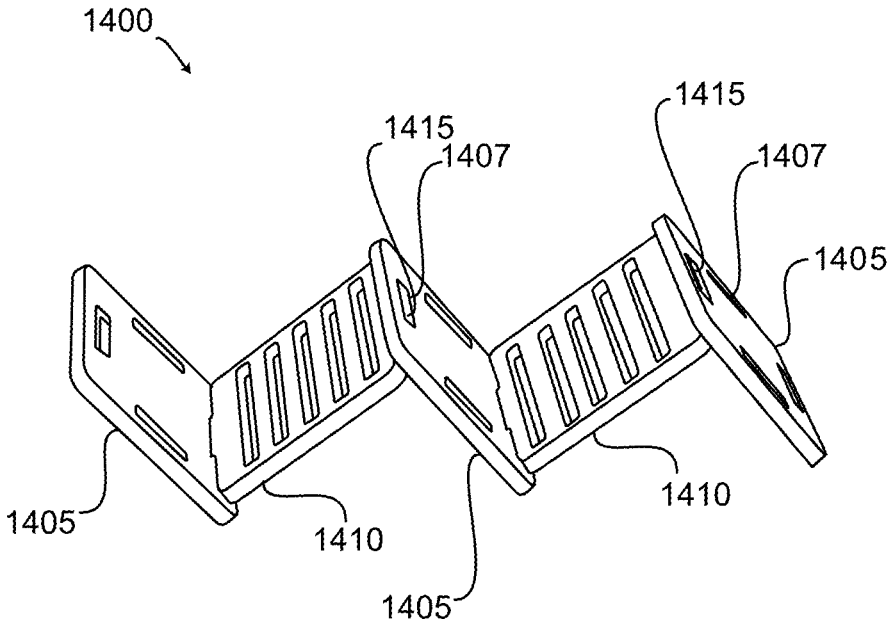
FIG. 14 illustrates a side perspective view of a staircase formed from building toy components in accordance with embodiments of the present invention.

FIG. 14 illustrates a side perspective view of a staircase 1400 formed from building toy components in accordance with embodiments of the present invention. In particular, staircase 1400 is formed by connecting four-slot building toy components 1405 to five-slot double-tab building toy components 1410. In particular, tabs 1415 of five-slot double-tab building toy components are inserted into slots 1407 of four-slot building toy components 1405.

Figure 15:
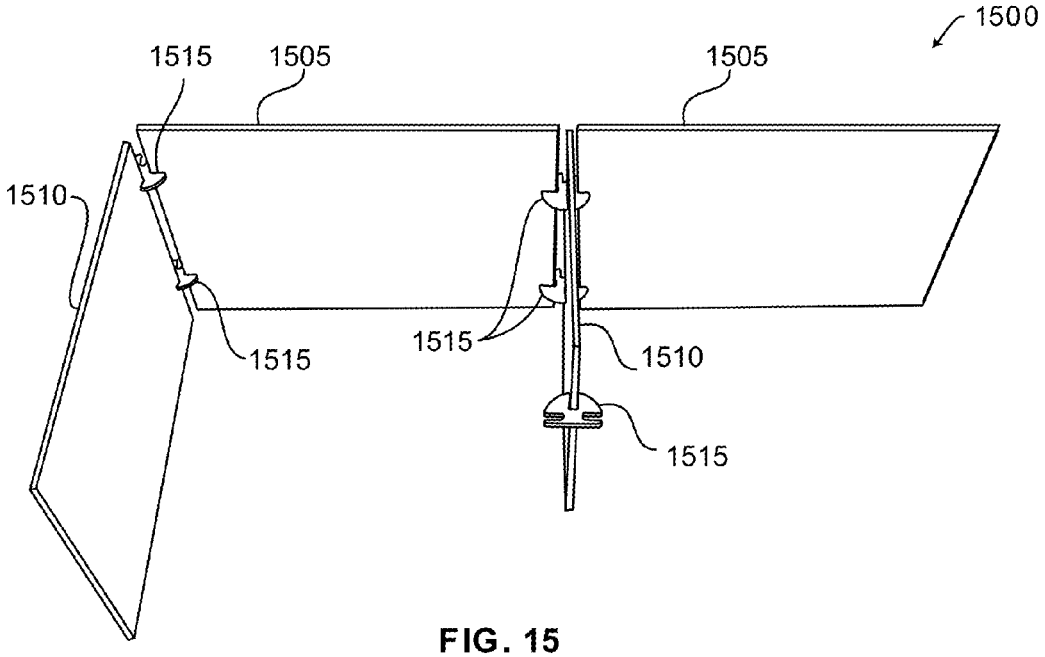
FIG. 15 illustrates a top perspective view of a first configuration of wall paneling in accordance with embodiments of the present invention.

FIG. 15 illustrates a top perspective view of a first configuration 1500 of wall paneling in accordance with embodiments of the present invention. In particular, FIG. 15 shows wall panels 1505, 1510, and half-circle connectors 1515. In particular, as seen in FIG. 15, wall panels 1505 run generally parallel to each other and wall panels 1510 run generally perpendicular to wall panels 1505. Further, wall panels 1505 and 1510 are connected using half-circle connectors 1515. In particular, wall panels 1505 and 1510 are fitted into the slots of half-circle connectors 1515. As such, the dimensions of the slots of half-connectors 1515 may be compatible with the thickness of wall panels 1505 and 1510.

Figure 16:
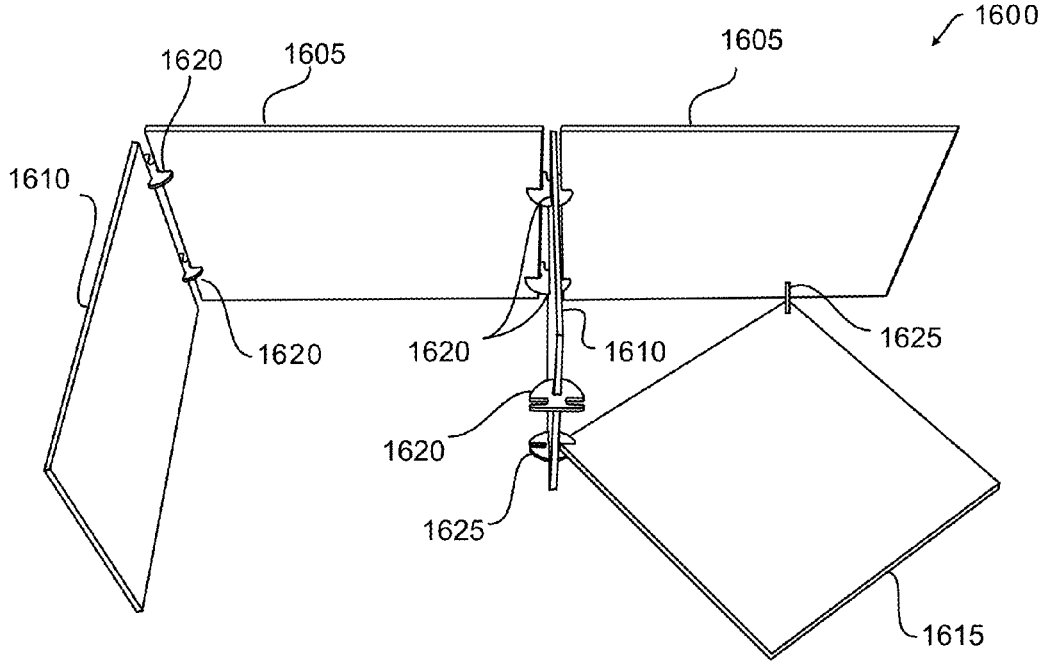
FIG. 16 illustrates a top perspective view of a second configuration of wall paneling in accordance with embodiments of the present invention.

FIG. 16 illustrates a top perspective view of a second configuration 1600 of wall paneling in accordance with embodiments of the present invention. In particular, FIG. 16 shows wall panels 1605, 1610, 1615, and half-circle connectors 1620. In particular, as seen in FIG. 16, wall panels 1605 and 1610, respectively, run generally parallel to each other, and wall panels 1615 run generally perpendicular to wall panels 1605 and 1610. In particular, wall panel 1615 is oriented at approximately a 45 degree angle to a portion of wall panel 1605 and a portion of wall panel 1610.

Further, wall panels 1605, 1610, and 1615 are connected using half-circle connectors 1620. In particular, wall panels 1605 and 1610 are fitted perpendicularly into the slots of half-circle connectors 1620. Further, a portion of the corners of wall panel 1615 are positioned within circle connectors 1625 so as to angle wall panel 1615 at an angle to a wall panel 1605 and 1610. As such, the dimensions of the slots of half-connectors 1620 and circle connectors 1625 may be compatible with the thickness of wall panels 1605, 1610, and 1615.

Figure 17:
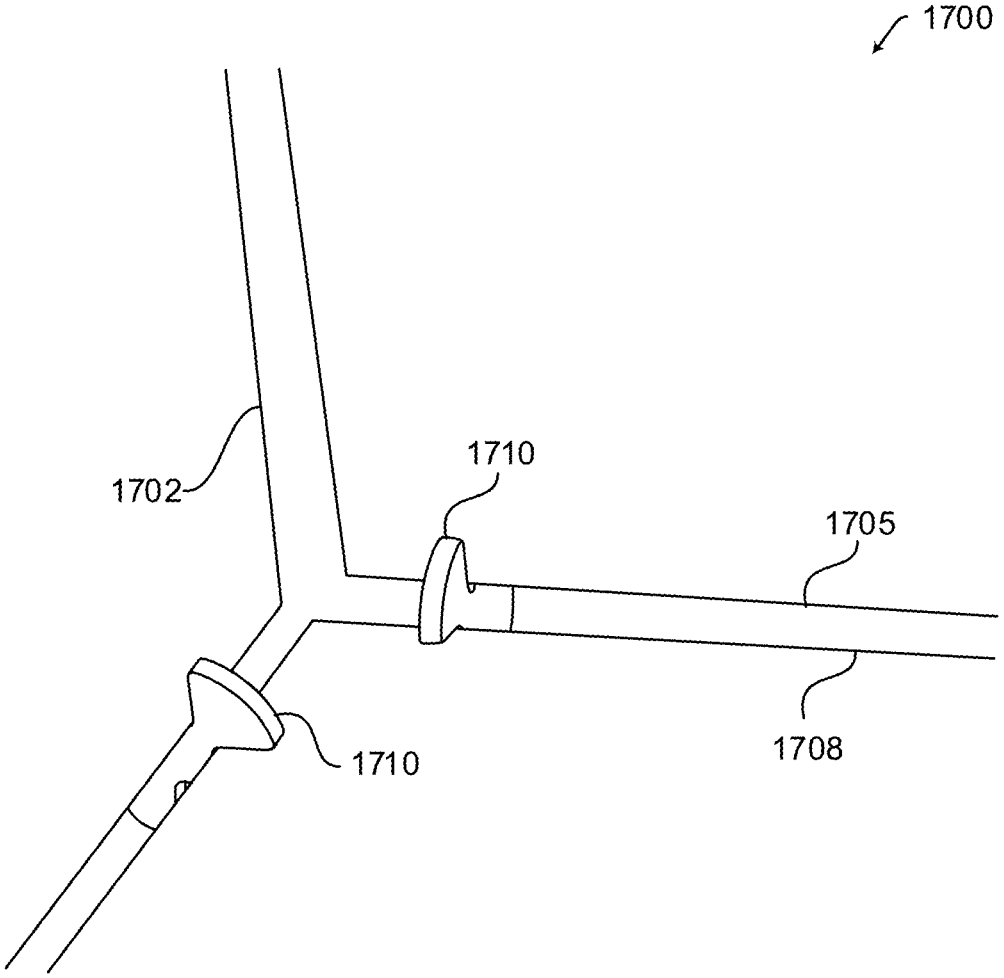
FIG. 17 illustrates a close-up perspective view of a third configuration of wall paneling as seen in FIG. 16 in accordance with embodiments of the present invention.

FIG. 17 illustrates a close-up perspective view of a third configuration 1700 of wall paneling in accordance with embodiments of the present invention. In particular, FIG. 17 illustrates wall panels 1702, 1705, and 1708 as connected by circular connectors 1710. As seen in FIG. 17, panels 1702, 1705, and 1708 are fitted into the slots of circular connectors 1710.

Figure 18:
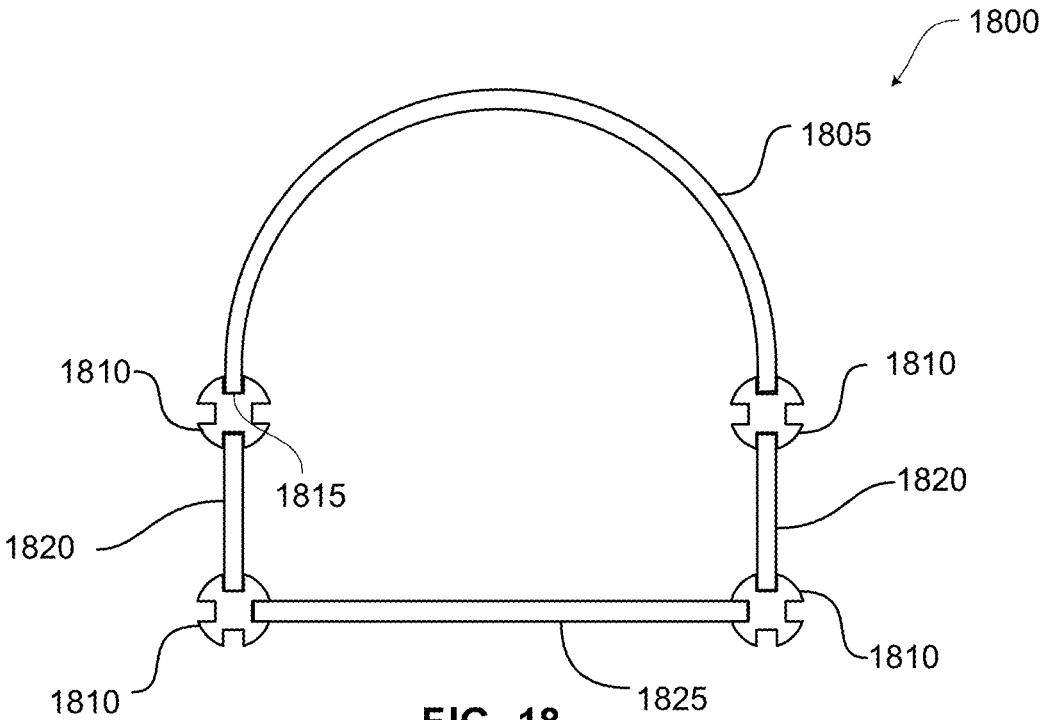
FIG. 18 illustrates a front view of a curved roof wall paneling in accordance with embodiments of the present invention.

Additionally, wall panels may be flexible enough to curve. As such, FIG. 18 illustrates a front view 1800 of a curved roof wall paneling in accordance with embodiments of the present invention. In particular, wall panel 1805 is curved such that two sides of wall panel 1805 are secured with notches 1815 of circle connectors 1810. The thickness of wall panel 1805 is compatible with the thickness of circle connector 1810. Further, wall panels 1830 are also secured using circle connectors 1810. In particular, wall panels 1820 extend downward from the sides of wall panel 1805. Wall panels 1820 are also connected to one another through wall panel 1825 that serves as a floor. Wall panels 1820 are secured to wall panel 1825 using circle connectors 1810.

Figure 19:
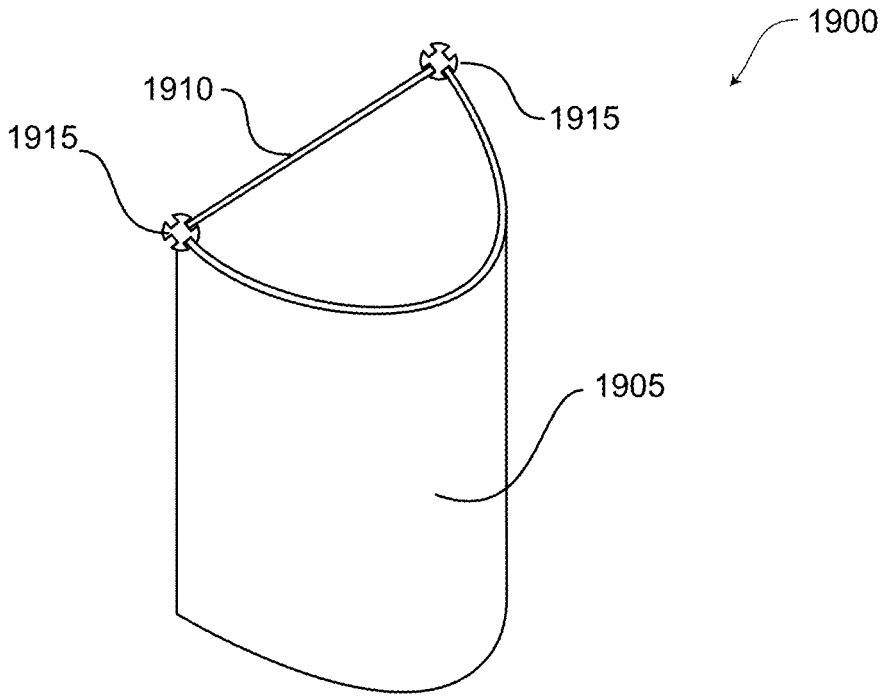
FIG. 19 illustrates a top perspective view of a curved roof wall paneling in accordance with embodiments of the present invention.

In alternative embodiments, semicircular connectors may be used to connect wall panel 1805 to wall panels 1820. Further, quarter-circular connectors may alternatively be used to connect wall panels 1820 to wall panel 1825. In a further embodiment of a curved wall panel, FIG. 19 illustrates a top perspective view of a curved roof wall paneling 1900 in accordance with embodiments of the present invention. In particular, FIG. 19 illustrates a curved wall panel 1905 that is connected to a floor paneling 1910 using connectors 1915. Wall panels, such as wall panels 1805 and 1905, may be curved enough so as to form circles or cones that are secured using connectors. For example, tubes maybe formed by securing sides of wall panels into opposing slots of a circular or semi-circular connector. Alternatively, wall panels maybe curved in wave patterns, such as sine wave patterns. Accordingly, flexible wall panels may be used to form many configurations in accordance with embodiments of configurations constructed using building toy components, connectors, wall panels, etc.

Figure 20:
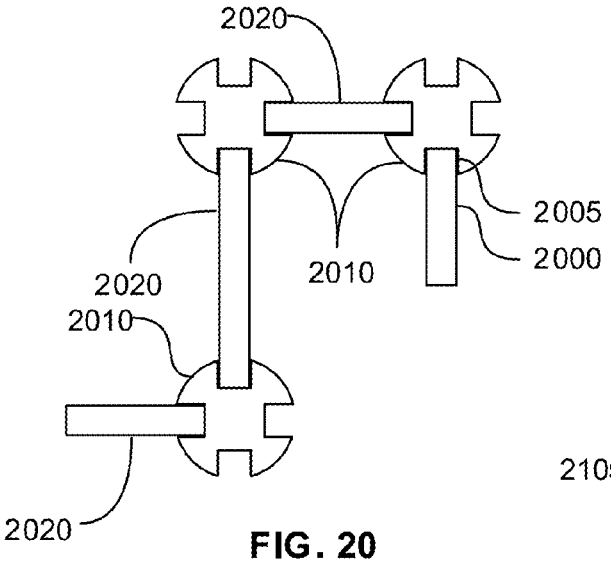
FIG. 20 illustrates a side view of a hanging wall panel in accordance with embodiments of the present invention.

The secure fit of wall panels within slots of connectors may be sufficient enough to support the weight of the wall panel. Accordingly, FIG. 20 illustrates a side view of a hanging wall panel 2000 in accordance with embodiments of the present invention. In particular, hanging wall panel 2000 is secured to connector 2010, which is also connected to wall panel 2020. In particular, hanging wall panel 2000 is fit within slot 2005 of connector 2010. Further, the weight of hanging wall panel 2000 is supported by the press fit of wall panel 2000 within slot 2005 of connector 2010. The amount of weight that may be supported is determined by the degree of fit between wall panel 2000 and connector 2010. In particular, the amount of weight that may be supported is based on the tightness of the press fit between hanging wall panel 2000 and connector 2010. Additionally, this would apply to fit in other components described herein, such as building toy components, connector components, wall panels, etc.

Figure 21:
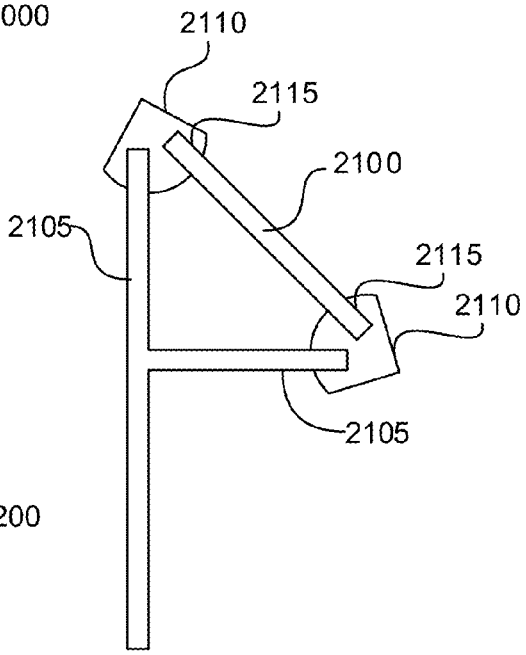
FIG. 21 illustrates a side view of an angled wall panel in accordance with embodiments of the present invention.

In addition to having perpendicular connections between wall components, an angled fit may also be achieved by using connectors that have varied angles. Accordingly, FIG. 21 illustrates a side view of an angled wall panel 2100 in accordance with embodiments of the present invention. In particular, wall panel 2100 is secured to wall panels 2105 using connectors 2110 having slots 2115. Slots 2115 of connectors 2110 have acute angles so as to secure wall panel 2100 in an angled position.

Figure 22:
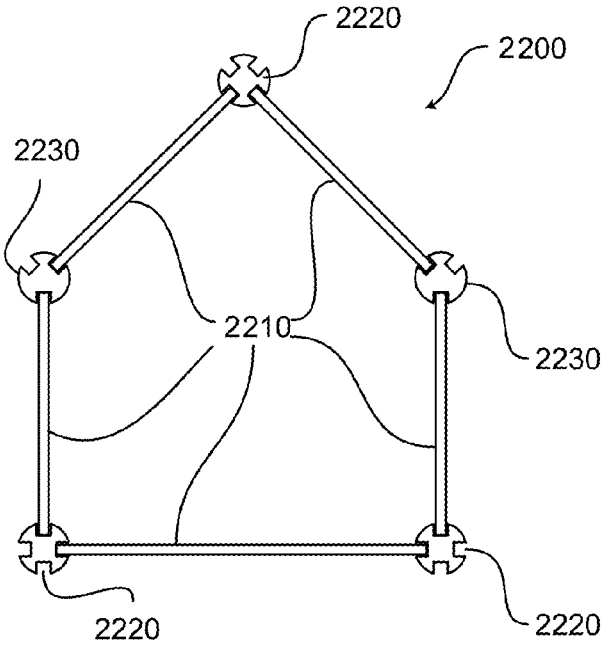
FIG. 22 illustrates a front view of a house-shaped wall configuration in accordance with embodiments of the present invention.

Angled wall panels may also be used to create angled roofs. In particular, FIG. 22 illustrates a front view of a house-shaped wall configuration 2200 in accordance with embodiments of the present invention. In particular, wall panels 2210 are connected using four-slot circular connectors 2220 and three-slot circular connectors 2230. In particular, four-slot circular connectors 2220 connect wall panels 2210 at right-angles, while three-slot circular connectors 2230 are able to angle some wall panels 2210 at an obtuse angle so as to provide an angled roof.

FIG. 23 illustrates a perspective view 2300 of a disconnected electronic lightbulb in accordance with embodiments of the present invention. In particular, FIG. 23 includes battery 2310 and lightbulb 2320. The wires of the complementary electronic components are coupled using connectors. The connectors have a plug (the male side) and a receptacle (the female side). In FIG. 23, battery 2310 has two plugs 2312 and 2314 and light 2320 has two receptacles 2322 and 2324. As such, battery 2310 may be plugged directly into lightbulb 2320. In alternative embodiments, battery 2310 may have two receptacles, such as receptacles 2322 and 2324, while lightbulb 2320 may have two plugs, such as plugs 2312 and 2314. As such, battery 2310 and lightbulb 2320 will have complementary plugs and receptacles. As shown in FIG. 23, however, lightbulb 2320 is unlit as it is not yet plugged in. In order to increase the ease of use, the connectors are easy to connect and unconnect. In particular, the connectors can be easily plugged and unplugged. While industry standard connectors have a locking mechanism, and while the use of a locking mechanism is enabled in the discussion herein, embodiments discussed are also enabling of connectors without locking mechanism so as to allow children to more easily plug and unplug the connectors.

Figure 24:
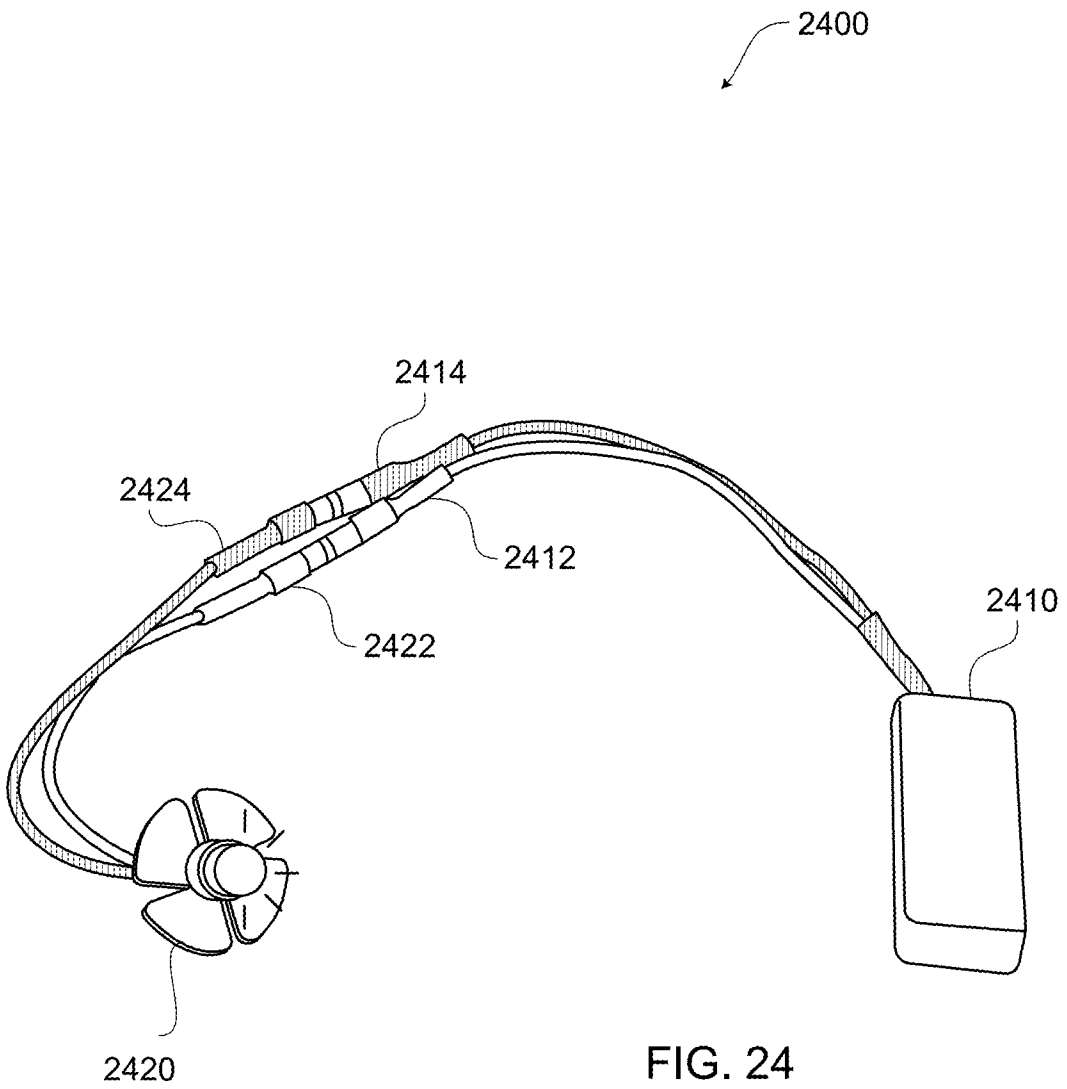
FIG. 24 illustrates a perspective view of a connected electronic lightbulb in accordance with embodiments of the present invention.

Accordingly, FIG. 24 illustrates a perspective view 2400 of a connected electronic lightbulb in accordance with embodiments of the present invention. In particular, FIG. 24 shows a battery 2410 having two plugs 2412 and 2414 that are connected to two receptacles 2422 and 2424 of lightbulb 2420. Further, lightbulb 2420 is lit, meaning battery 2410 is in an "on" position. Additionally, the wires of the electronic components are covered with heat shrink. This keeps the wires from being exposed. The heat shrink-covered wires are then attached to connectors that are then covered with a second layer of heat shrink. This second layer of heat shrink allows for more stress/strain surrounding the wire-and-connector attachment, so that the wire-and-connector attachment doesn't pop off. Further, the connectors have a plastic guard that keeps the wires from being exposed to users of the electronic components.

Figure 25:
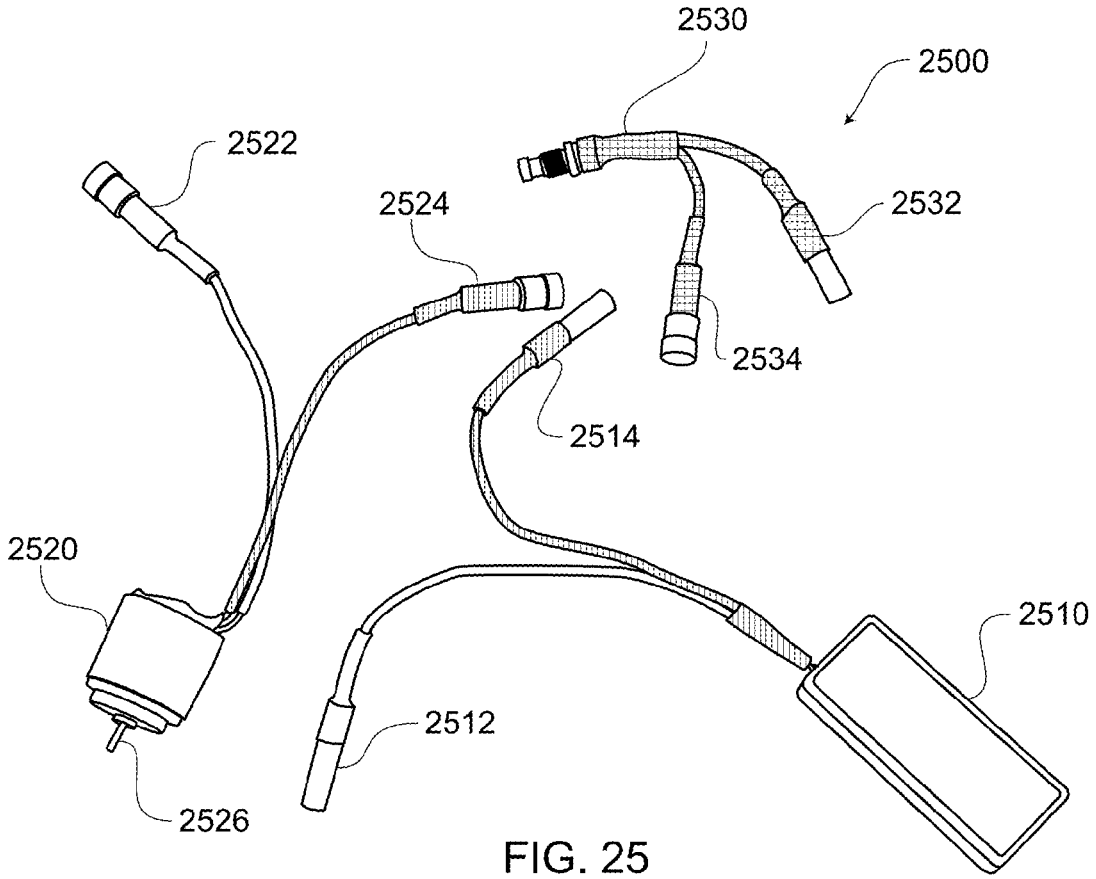
FIG. 25 illustrates a perspective view of complementary electronic components in accordance with embodiments of the present invention.

Further, additional components may also be added. Accordingly, FIG. 25 illustrates a perspective view of complementary electronic components in accordance with embodiments of the present invention. In particular, FIG. 23 includes battery 2310, motor 2320, and switch 2330. Switch 2330 may be a pressure-based switch, where the switch is only engaged when the pressure is placed on the switch. Alternatively, switch 2330 may be a binary switch that stays on when it is engaged until it is turned off again.

As seen in FIGS. 23 and 24, the wires of the complementary electronic components are coupled using connectors. The connectors have a plug (the male side) and a receptacle (the female side). In FIG. 25, battery 2510 has two plugs 2512 and 2514 and motor 2520 has two receptacles 2522 and 2524. In alternative embodiments, battery 2510 may have two receptacles, such as receptacles 2522 and 2524, while motor 2520 may have two plugs, such as plugs 2512 and 2514. As such, battery 2510 and motor 2520 will have complementary plugs and receptacles. As such, battery 2510 may be plugged directly into motor 2520. Additionally, motor 2520 also comprises a rotating axle 2526 such that motor 2526 may be used to rotate objects attached to rotating axle 2526. For example, a holed circular connector component, such as that seen in FIG. 7D, may be used to attach objects to rotating axle 2526.

Further, switch 2530 has one plug 2532 and one receptacle 2534 so that it may be attached to battery 2510 as well as motor 2520.

Figure 26A:
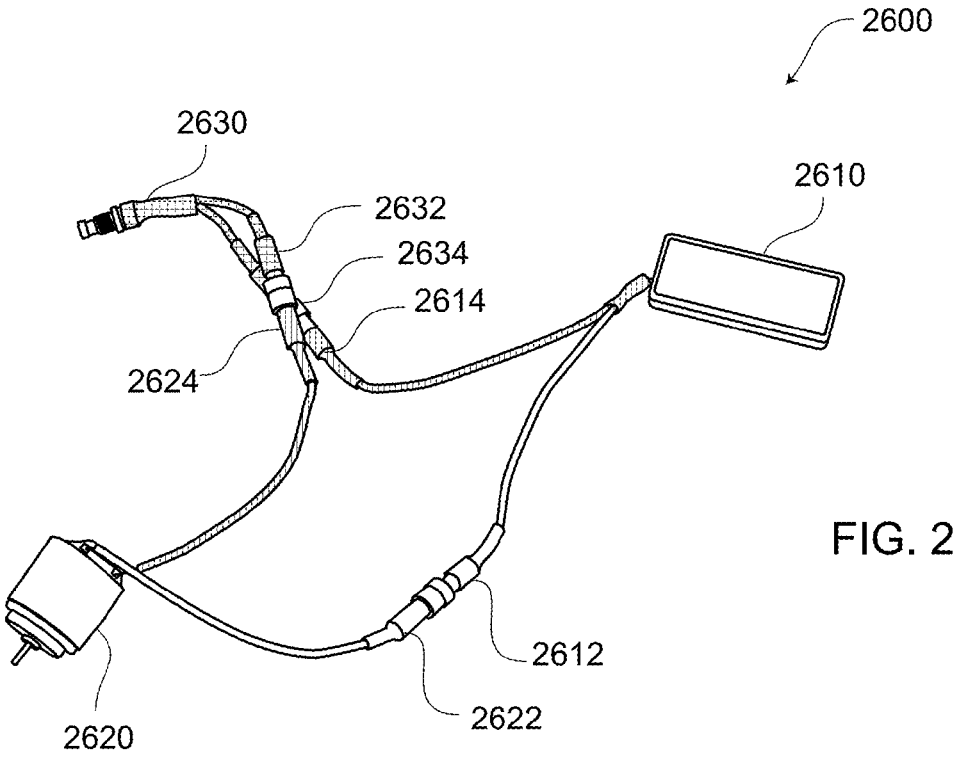
FIGS. 26A and 26B illustrate two compatible configurations of electronic components in accordance with embodiments of the present invention.
Figure 26B:
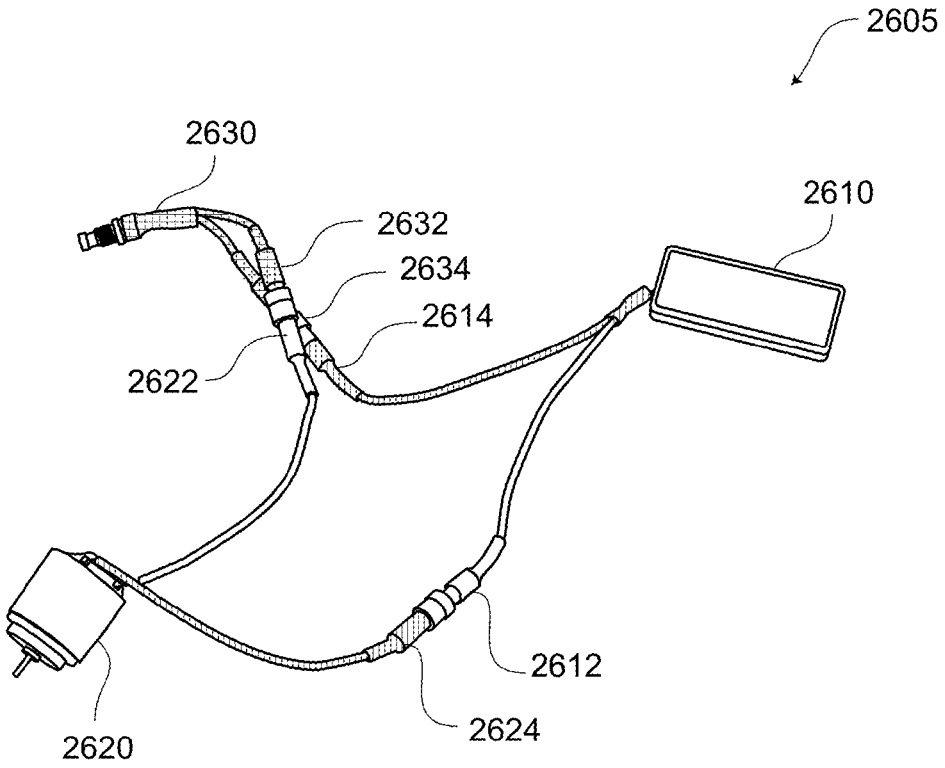

Further, so long as plugs are matched with receptacles, circuits will be completed and electronic components will be operable. Accordingly, FIGS. 26A and 26B illustrate two compatible configurations of electronic components in accordance with embodiments of the present invention. In particular, FIGS. 26A and 26B includes battery 2610 having two plugs 2612 and 2614, motor 2620 having two receptacles 2622 and 2624, and switch 2630 having one plug 2632 and one receptacle 2634 so that it may be attached to batter 2610 as well as motor 2620.

As such, FIG. 26A illustrates a perspective view of a first configuration 2600 of connected electronic components in accordance with embodiments of the present invention. As seen in FIG. 26A, plug 2612 is connected to receptacle 2622; plug 2614 is connected to receptacle 2634; and plug 2634 is connected to receptacle 2624. As discussed above, complementary electronic components may be connected together, independent of which component contains which connecting plug or receptacle, such that electronic components may be compatible even when the source of a plug or receptacle is opposite from embodiments discussed herein. Further, FIG. 26B illustrates a perspective view of a second configuration 2605 of connected electronic components in accordance with embodiments of the present invention. As seen in FIG. 26B, plug 2612 is connected to receptacle 2624; plug 2614 is connected to receptacle 2634; and plug 2632 is connected to receptacle 2622. In both configurations 2600 and 2605, each component is operable, though under first configuration 2600 the motor will run in a first direction (e.g., clockwise) while under second configuration 2605 the motor will run in a second, opposite direction (e.g. counterclockwise).

Figure 27:
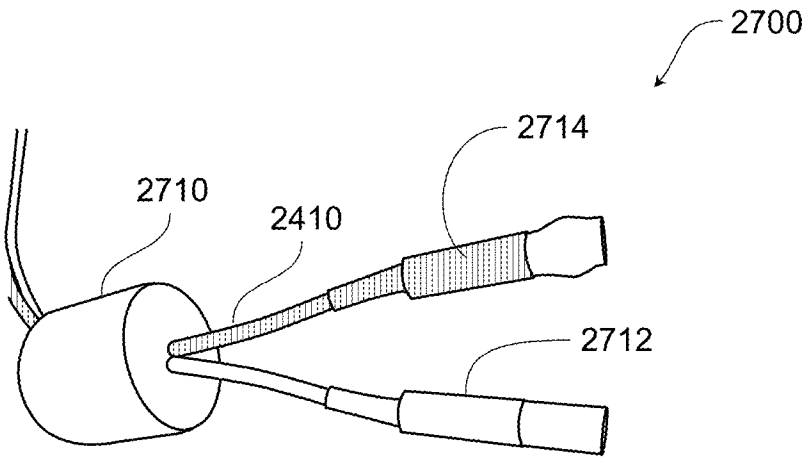
FIG. 27 illustrates a perspective view of a connected electronic motor in accordance with embodiments of the present invention.

FIG. 27 illustrates a perspective view of a motor 2700 having an electronics cover 2710 in accordance with embodiments of the present invention. In particular, electronics cover 2710 is designed to allow receptacles 2712 and 2714 as coming straight out of the back of motor 2710. This is distinct from a motor cover see covering motor 2520 in FIG. 25, where the output receptacles are wired against an edge of motor 2520.

Figure 28A:
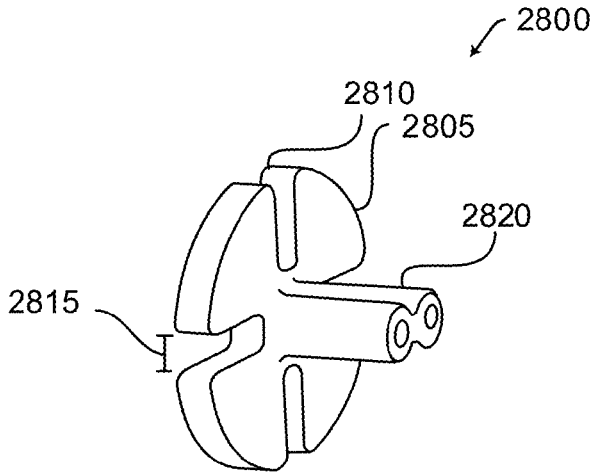
FIGS. 28A-28C illustrates view of a housing component in accordance with embodiments of the present invention.
Figure 28B:
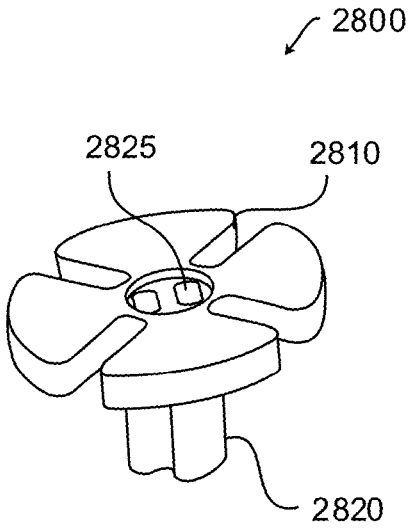
Figure 28C:
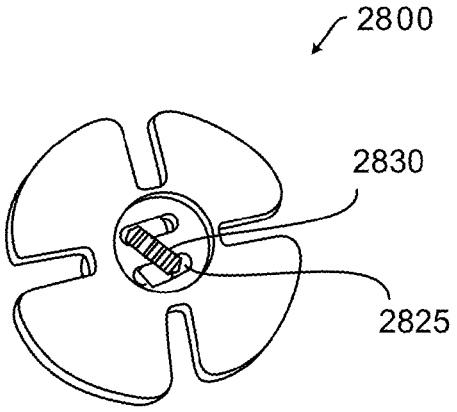

FIGS. 28A-28C illustrates view of a spinning connector component 2800 in accordance with embodiments of the present invention. In particular, spinning connector component 2800 is designed to attach compatible components, allowing them to be rotated. In particular, compatible components are connected to slots 2805. In particular, slots 2810 within main body 2805. Slots 2810 have a thickness 2815 that matches the thickness of compatible components such as building toy components, connectors, and wall panels discussed herein. Further, slots 2810 have a sufficient width and length to hold compatible components securely. In additional embodiments, engagement strips may also be added to slots 2810 in order to more securely attached components.

As such, FIG. 28A illustrates a back perspective view of a housing component 2800 building toy component in accordance with embodiments of the present invention. Housing component 2800 protects the LED and resistor in the building toy component. In particular, FIG. 28A includes a main body 2805 having slots 2810 and wire covers 2820. In particular, wire covers 2820 are used to house wires that are attached to a resistor. Further, FIG. 28B illustrates a top perspective view of the housing component 2800 in accordance with embodiments of the present invention. FIG. 28B includes the elements of 28A, including wire opening 2825. Further, FIG. 28C illustrates a front perspective view of the housing component 2800 in accordance with embodiments of the present invention. In particular, FIG. 28C includes a resistor 2830 having wires that descend through wire opening 2825, passing through wire covers 2820 to engage electronic components.

Figure 29:
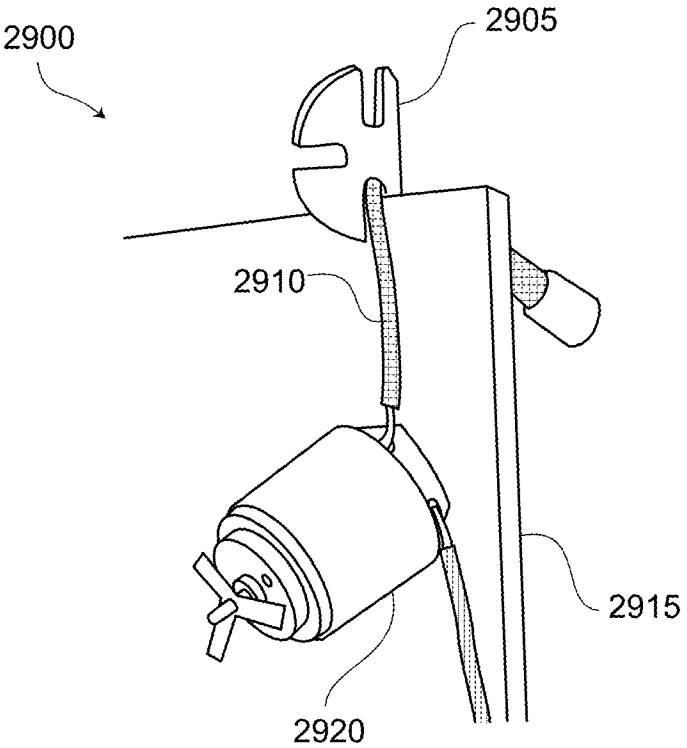
FIG. 29 illustrates a perspective view of a first configuration of a connector securing a wiring component in accordance with embodiments of the present invention.

FIG. 29 illustrates a perspective view of a first configuration 2900 of a connector 2905 securing a wiring component 2910 in accordance with embodiments of the present invention. In particular, a slot within connector 2905 has a thickness that is compatible with the thickness of wiring component 2910. This compatibility is designed so that electronic components, include wiring such as wiring component 2910 of motor 2920, may be integrated into the designs of rooms and buildings, particular when wall panels are connected using connectors such as 2905. Further, the depth of slots in connector 2905 is such that wiring component 2910 may pass through and still leave sufficient depth of the slot of connectors 2905 so as to allow connector 2905 engage a wall panel with sufficient depth to as to secure connector 2905 to wall panel 2915. Accordingly, when these conditions are met, connectors may serve dual and simultaneous roles: integrating wiring components as well as connecting wall panels to other building toy components (such as other wall panels, building toy components, other connectors, etc.).

Figure 30:
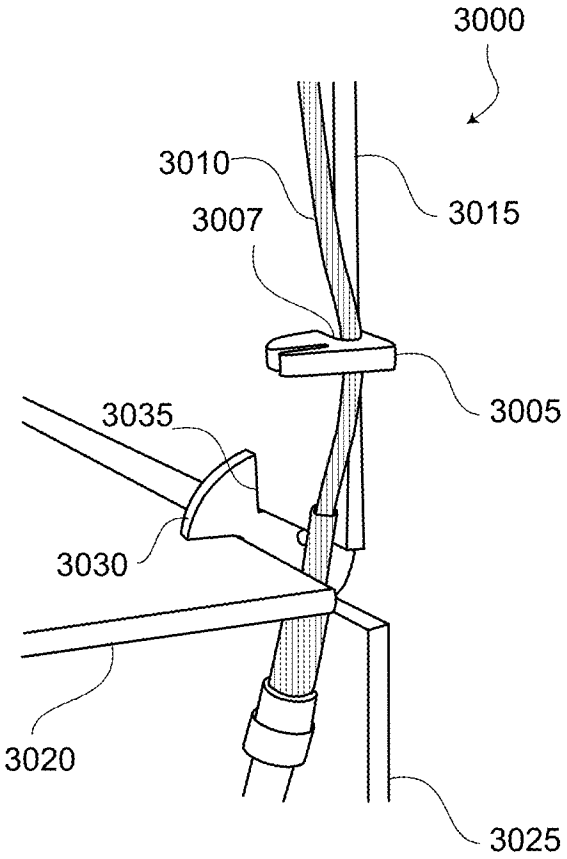
FIG. 30 illustrates a perspective view of a second configuration of a connector securing a wiring component in accordance with embodiments of the present invention.

FIG. 30 illustrates a perspective view of a second configuration 3000 of a connector 3005 securing a wiring component 3010 in accordance with embodiments of the present invention. Connector 3005 is a quarter-connector. A slot 3007 within connector 3005 has a thickness that is compatible with the thickness of wiring component 3010. Additionally, a thickness between wall panels 3015, 3020, and 3025 is also compatible with the thickness of wiring component 3010. As such, the opening that is created between wall panels 3015, 3020, and 3025 is sufficient so as to allow wiring component 3010 to pass through the opening. The thickness of this opening is based on the design of circular connector 3030 which is used to connect wall panels 3015, 3020, and 3025. In particular, the slots 3035 of circular connector 3030 are deep enough to secure wall panels, but are shallow enough so as to allow sufficient clearance for wiring component 3010 to pass through the opening between wall panels 3015, 3020, and 3025.

Figure 31:
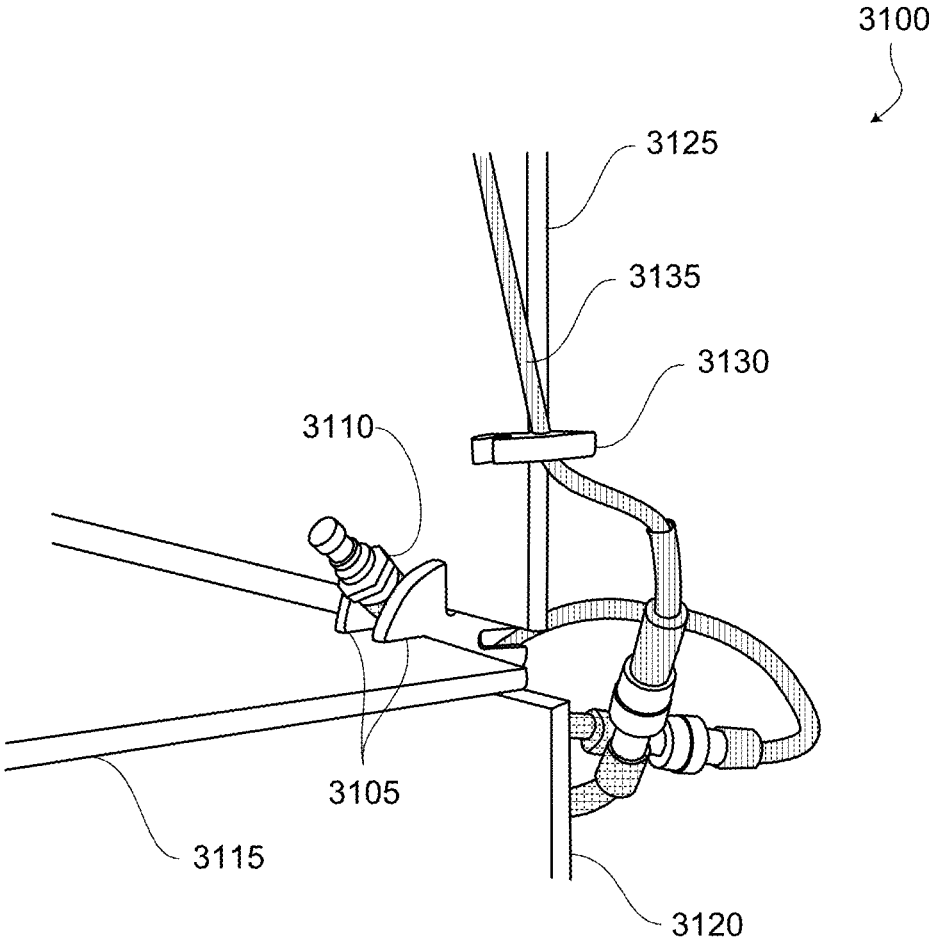
FIG. 31 illustrates a perspective view of connectors securing a switch component in accordance with embodiments of the present invention.

FIG. 31 illustrates a perspective view 3100 of connectors 3105 securing a switch component 3110 in accordance with embodiments of the present invention. In particular, switch component 3110 is sandwiched between connector components 3105. Connector components 3105 are circular connector components that are secured to wall panels 3115, 3120, and 3125. Additionally, FIG. 31 also illustrates a quarter-circular connector 3130 securing a wire 3135 to wall panel 3125.

Figure 32A:
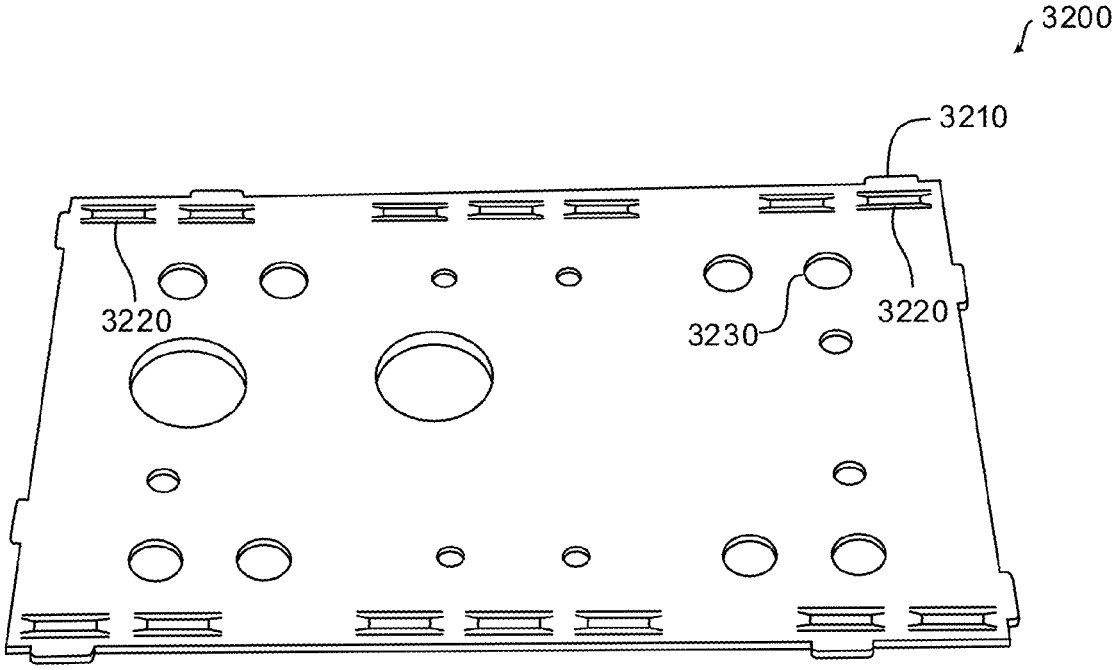
FIG. 32A illustrates a perspective view of a wooden wall panel in accordance with embodiments of the present invention.

FIG. 32A illustrates a perspective view of a wooden wall panel 3200 in accordance with embodiments of the present invention. In particular, the slotted wood-based panel 3200 includes tabs 3210, slots 3220, and apertures 3230. Wood panels are not as durable as plastic panels. In particular, wood panels are susceptible to change dimensions due to weather conditions. As such, if a wood panel is sent to a location with high humidity, the notches and tabs may change dimensions and/or warp.

Tabs 3210 are aligned to be connected at a 90-degree angle with other wood-based panels by placing tables 3210 of a first wood-based panel 3200 into slots, such as slots 3220, of a second panel. Further, the orientation of tabs 3210 allows for the first wood-based panel to be placed as a wall of a first-story section of a building having a ceiling of the second panel, while a third panel may be placed as a wall of a second-story section of the building having the second panel as flooring. Further, apertures 3230 within the wood-based panel 3200 may be used to display decorations, pass through wiring for the integration of electronic components, or both.

Figure 32B:
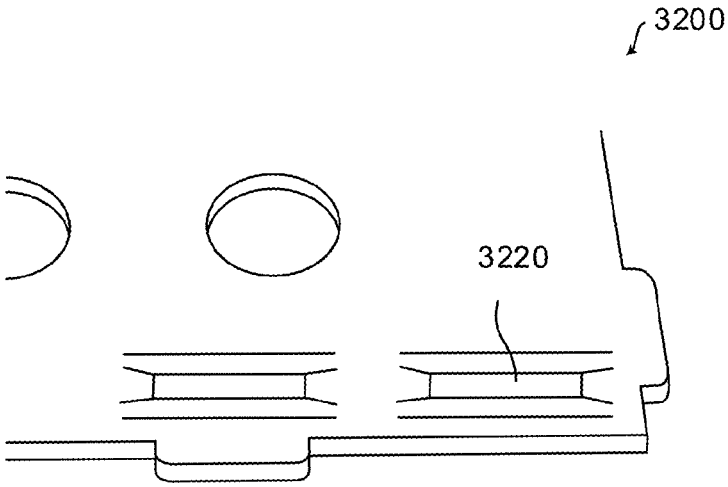
FIG. 32B illustrates a close-up perspective view of the wooden wall panel of FIG. 32A in accordance with embodiments of the present invention.

FIG. 32B illustrates a close-up perspective view of the wooden wall panel 3200 of FIG. 32A in accordance with embodiments of the present invention. In particular, FIG. 32B illustrates slots 3220 that are formed so as to be compatible with tabs, such as tabs 3210. As seen in FIG. 32B, slots 3220 include corner cuts along the inner portion of slot 3220, and are also adjacent to stress relief cuts that lie above and below slot 3220. This allows wood panel 3200 to adapt to different sizes of tabs. It also allows slot 3220 to be flexible as the wooden base material of panel 3200 may change in dimensions due to humidity or other weather conditions.

Figure 33:
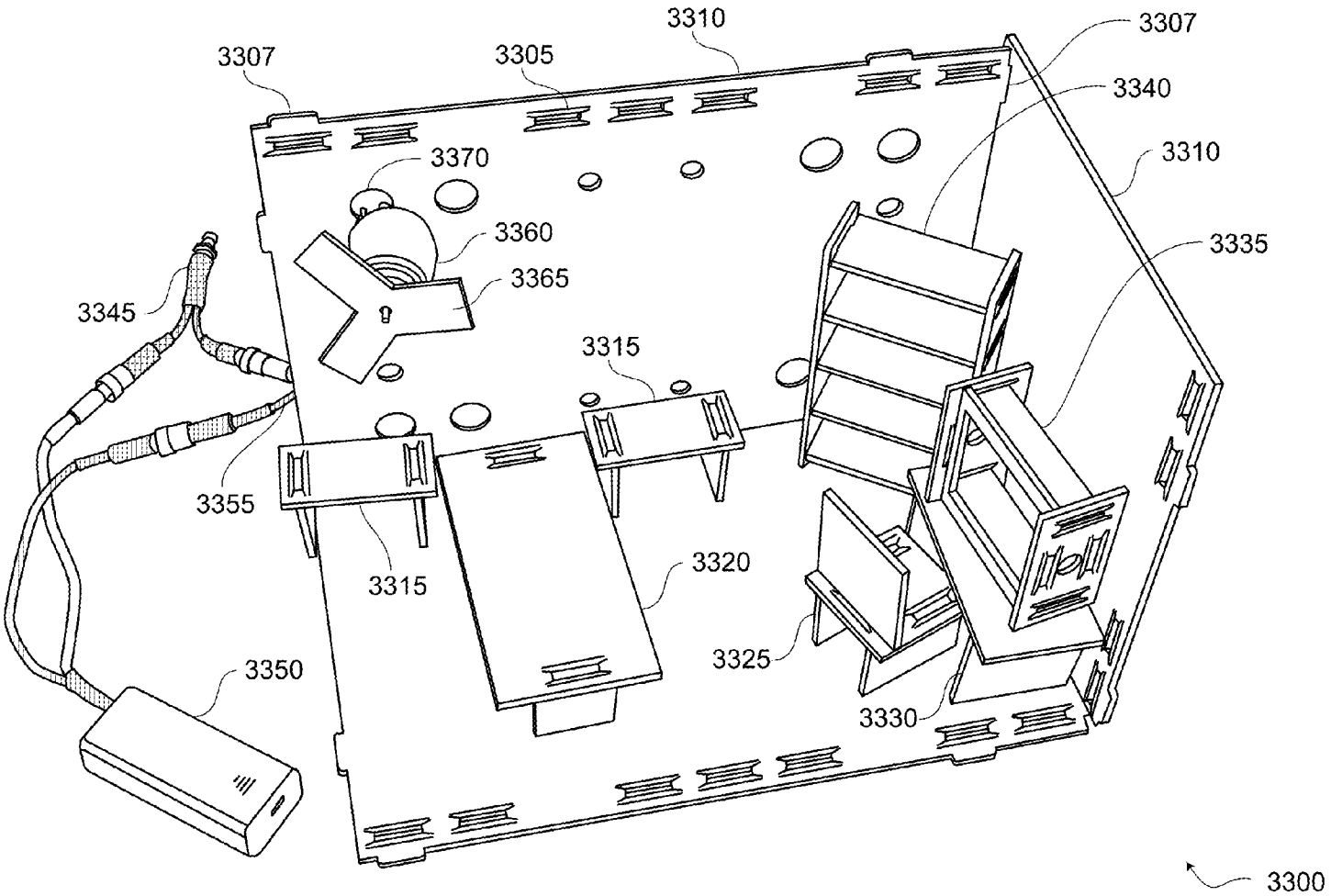
FIG. 33 illustrates a top perspective view of electronic components integrated in a built room environment in accordance with embodiments of the present invention.

FIG. 33 illustrates a top perspective view of electronic components integrated in a built room environment 3300 in accordance with embodiments of the present invention. In particular, FIG. 33 includes slots 3305, tabs 3307, panels 3310, tables 3315, coffee table 3320, chair 3325, desk 3330, televisions 3335, bookcase 3340, switch 3345, battery 3350, wires 3355, motor 3360, fan blade 3365, and aperture 3370. Furniture is formed using wooden building toy components such as those seen in FIG. 33. In particular, wooden building toy components are connected by inserting tabs into slots 3305. Further, a fan is created using motor 3360 and fan blade 3365. In particular, the fan is integrated into the structure of the room by passing the wiring of the fan through aperture 3370 in panel 3310.

Figure 34:
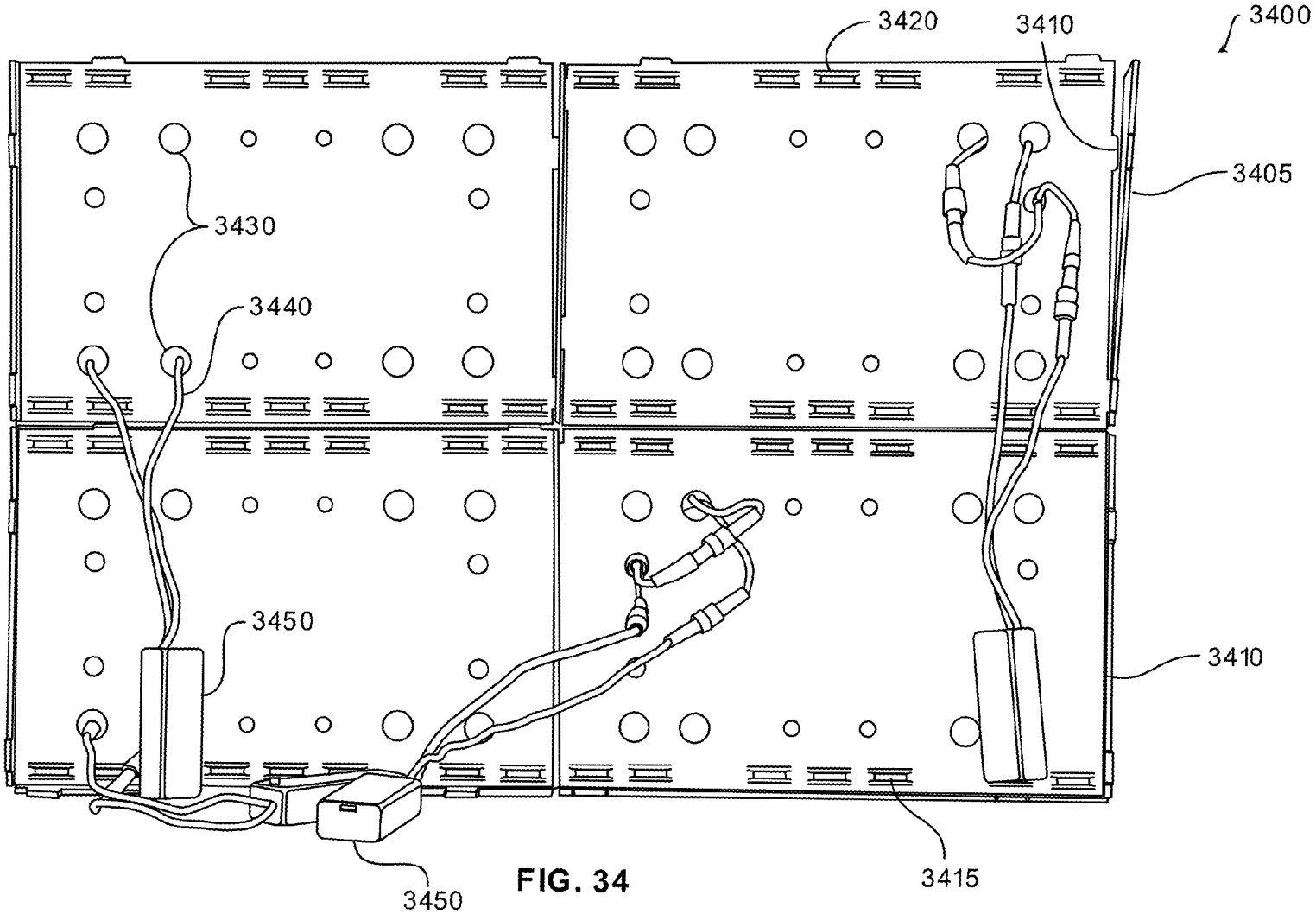
FIG. 34 illustrates a back view of electronic components integrated in a built room environment in accordance with embodiments of the present invention.

FIG. 34 illustrates a back view of electronic components integrated in a built room environment 3400 in accordance with embodiments of the present invention. In particular, FIG. 34 illustrates a two-story structure that is formed using slotted wood-based panels having apertures. Electrical components integrated through the apertures of the wood-based panels. As such, FIG. 34 includes panels 3405, tabs 3410, slots 3420, apertures 3430, wires 3440, and battery 3450. Accordingly, FIG. 34 illustrates an example of a first wood-based panel being secured to a second wood-based panel that acts as a ceiling. The second wood-based panel also acts as a floor to a second-story room that has a third wood-based panel secured to the second wood-based panel. As such, the tabs at the top of the first wood-based panel are complementary to the tabs of the bottom of the third wood-based panel such that either the first wood-based panel or the third wood-based panel occupies the outer four slots on the edge of the second wood-based panel.

Additionally, FIG. 34 also illustrates an example of the third wood-based panel being secured to a dividing wall comprising a fourth wood-based panel. The fourth wood-based panel acts as an adjoining wall to the third wood-based panel as well as the fourth wood-based panel. As such, the tabs at the side of the third wood-based panel are complementary to the tabs at the opposite side of the fifth wood-based panel such that either the third wood-based panel or the fifth wood-based panel occupies the edge four slots of the fourth wood-based panel. Further, FIG. 34 illustrates the integration of electronic components into the panels of the two-story building. In particular, wires of the electronic components are passed through apertures that are part of the wood-based panels. Apertures 3430 as shown in FIG. 34 are circles, but in alternative embodiments, apertures 3430 may be a number of other shapes, such as triangles, squares, etc, so long as the shaped apertures are able to pass through wires used to integrate electrical components to panels 3410.

Figure 35:
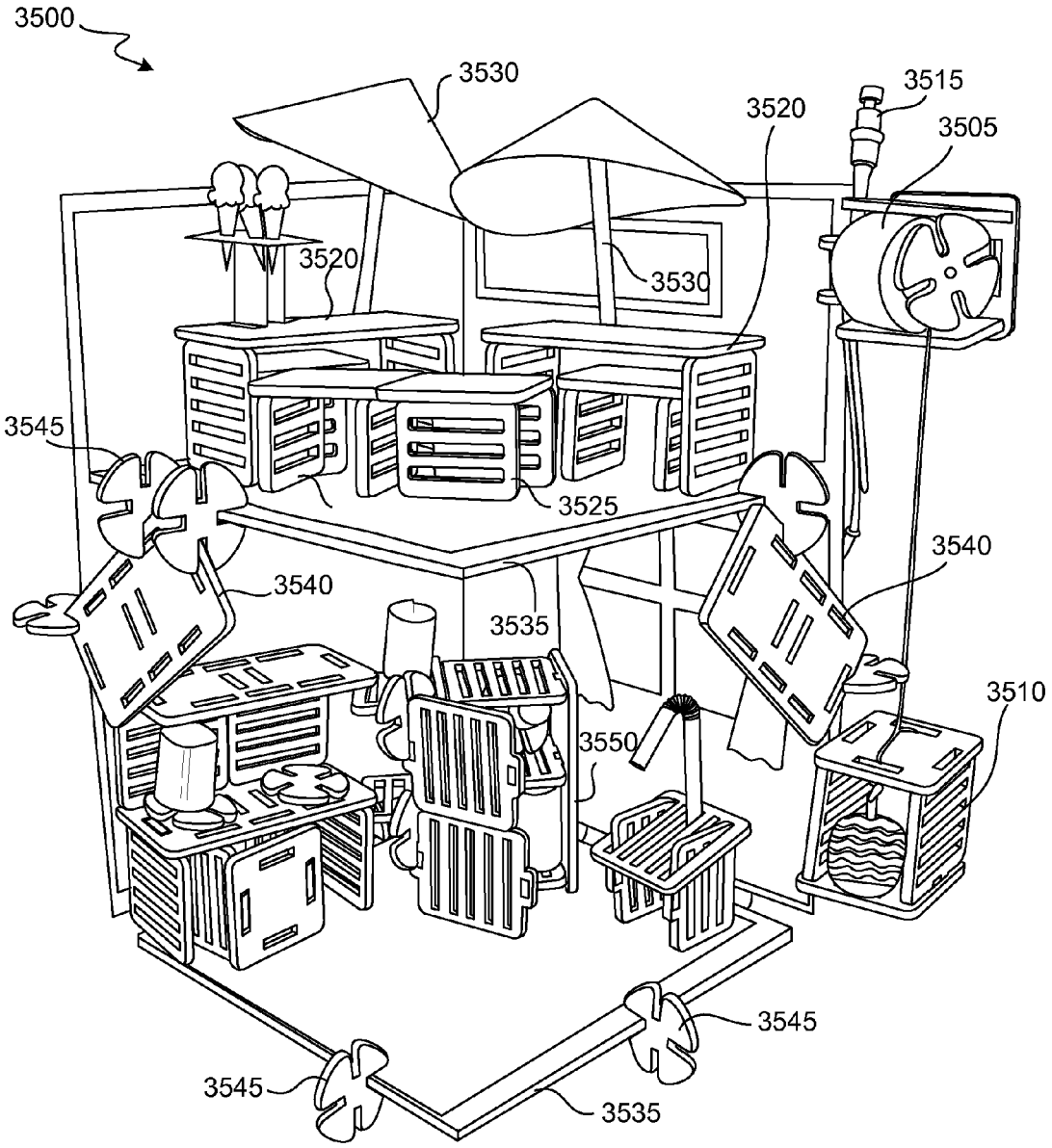
FIG. 35 illustrates a first built house environment in accordance with embodiments of the present invention.

FIG. 35 illustrates a first built house environment 3500 in accordance with embodiments of the present invention. In particular, FIG. 35 comprises elevator motor 3505, elevator car 3510, switch 3515, desks 3520, chairs 3525, umbrellas 3530, floor panels 3535, shade panels 3540, connectors 3545, and refrigerator 3550.

Figure 36:
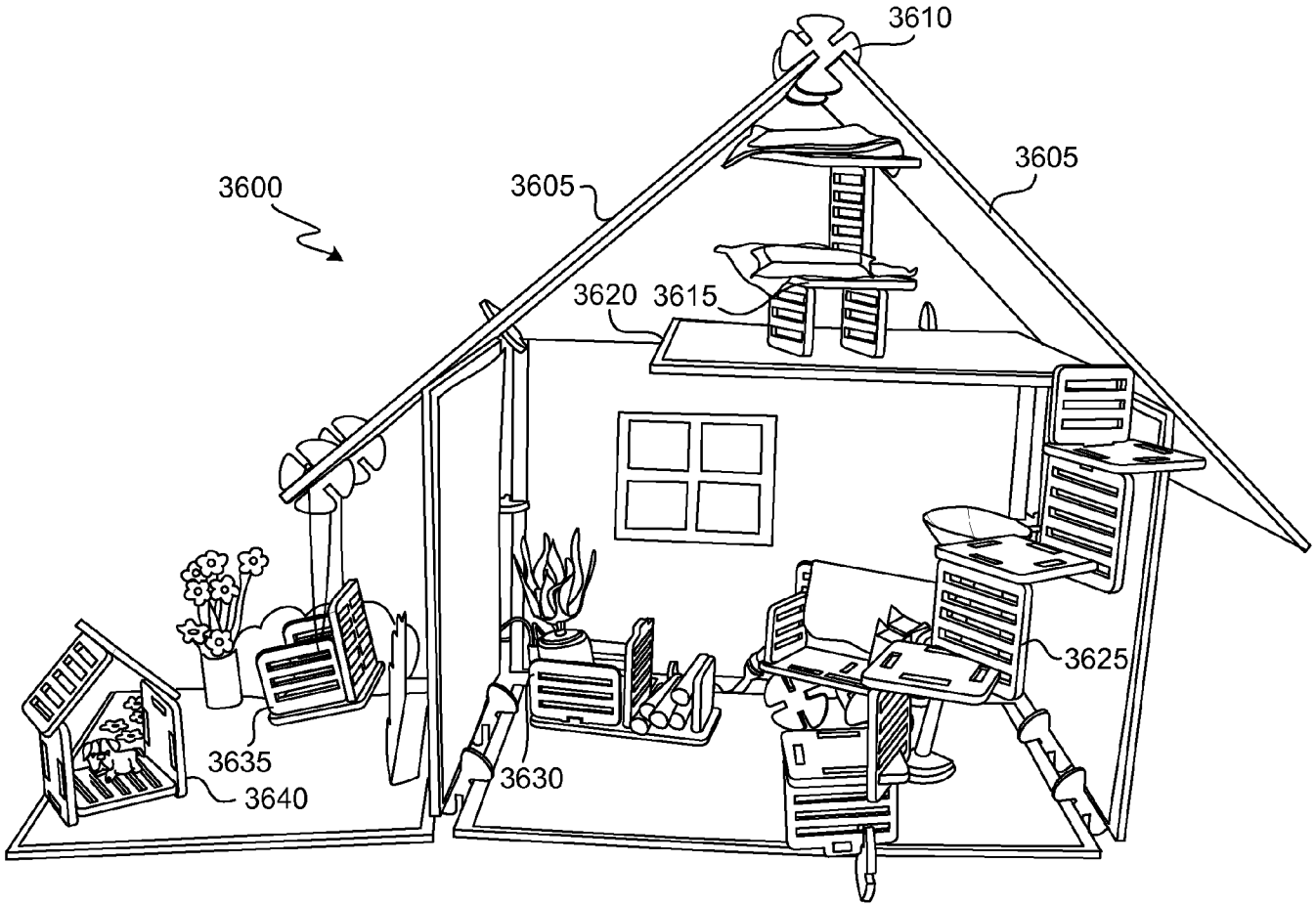
FIG. 36 illustrates a second built house environment in accordance with embodiments of the present invention.

FIG. 36 illustrates a second built house environment 3600 in accordance with embodiments of the present invention. In particular, FIG. 36 comprises roof panels 3605, connectors 3610, bed 3615, attic floor 3620, staircase 3625, fireplace 3630, porch swing 3635, and dog house 3640.

Figure 37:
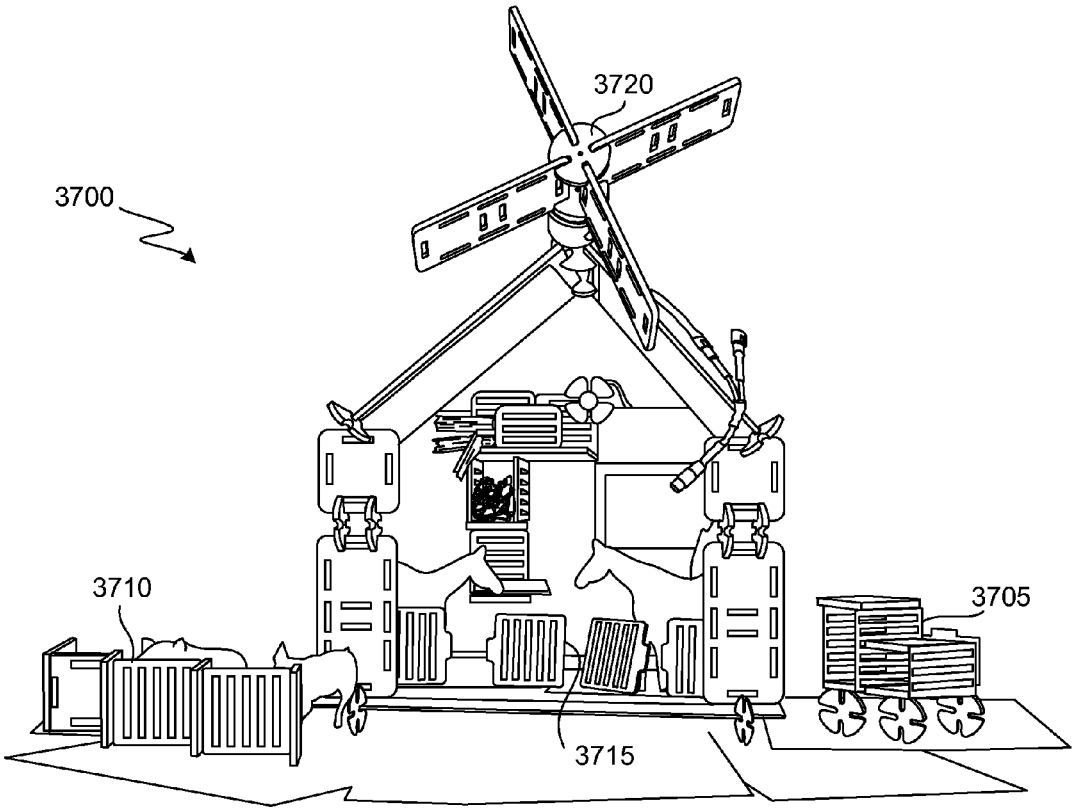
FIG. 37 illustrates a built horse stable environment in accordance with embodiments of the present invention.

FIG. 37 illustrates a built horse stable environment 3700 in accordance with embodiments of the present invention. In particular, FIG. 37 comprises car 3705, animal pen 3710, stable 3715, and windmill 3720.

Figure 38:
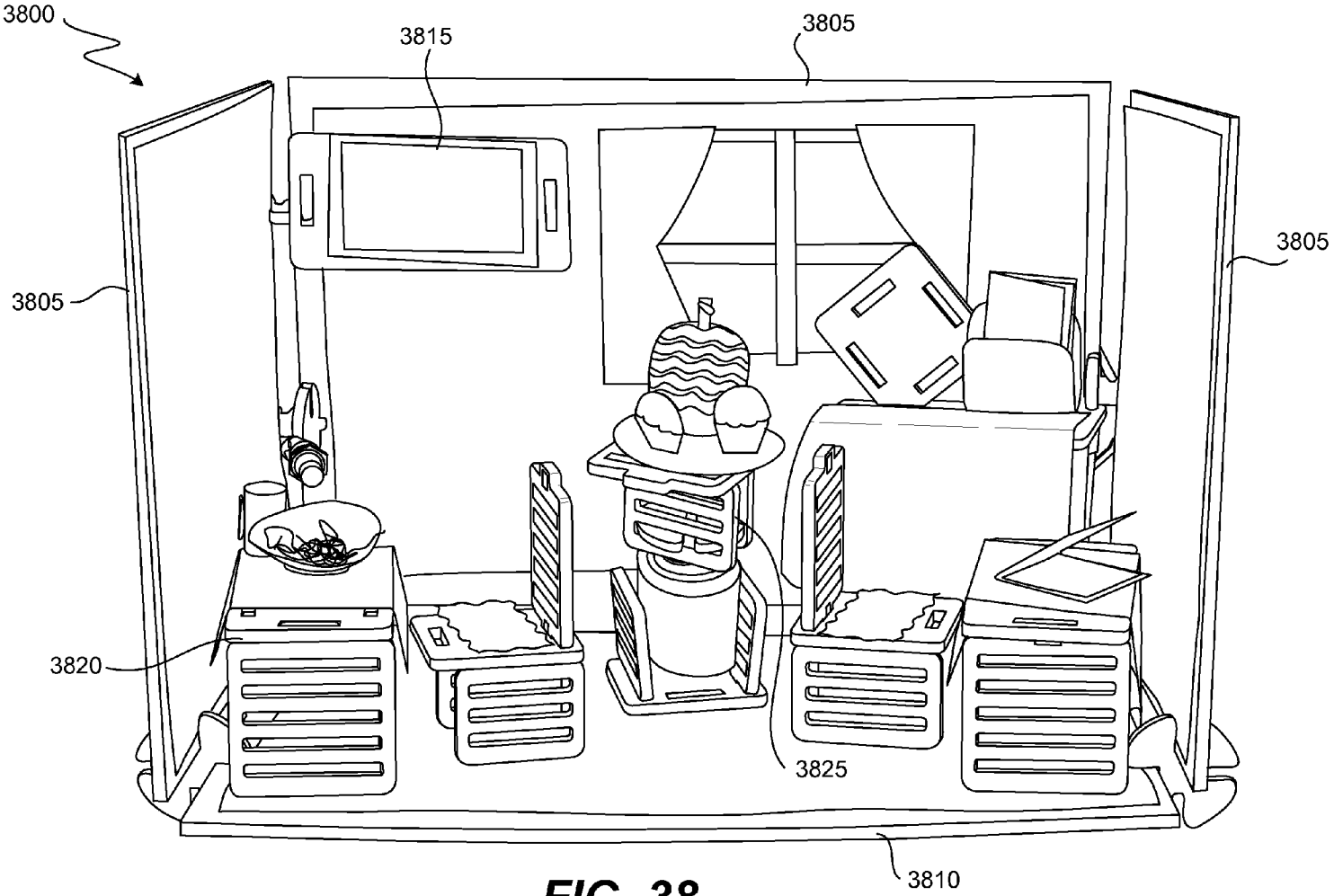
FIG. 38 illustrates a built cupcake shop environment in accordance with embodiments of the present invention.

FIG. 38 illustrates a built cupcake shop environment 3800 in accordance with embodiments of the present invention. In particular, FIG. 38 comprises wall panels 3805, floor panel 3810, sign 3815, desk 3820, and turntable 3825.

Figure 39:
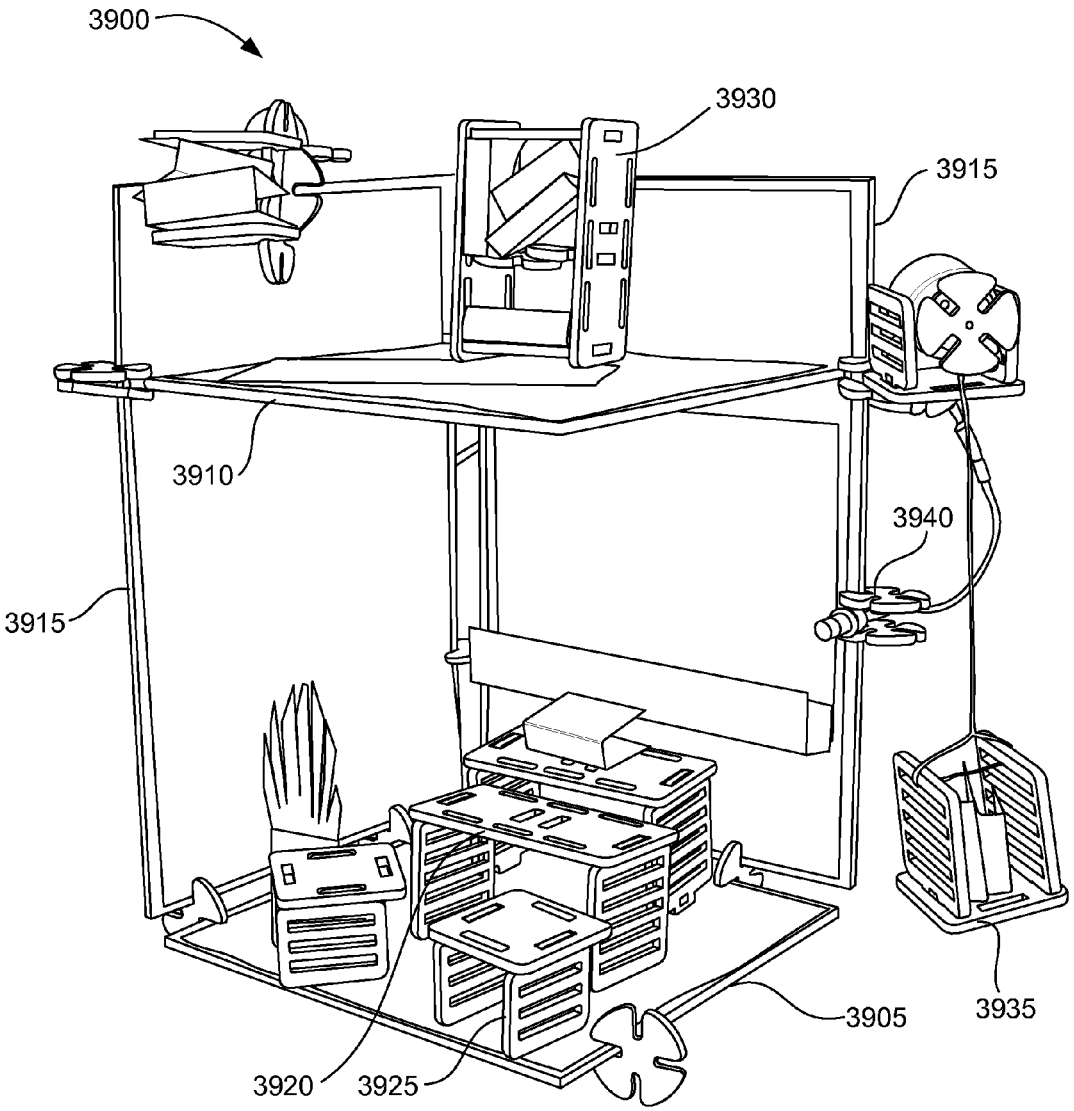
FIG. 39 illustrates a built school room environment in accordance with embodiments of the present invention.

FIG. 39 illustrates a built school room environment 3900 in accordance with embodiments of the present invention. In particular, FIG. 39 comprises floor panels 3905 and 3910, side panels 3915, desk 3920, chair 3925, bookcase 3930, elevator 3935, switch 3940, and connectors 3945. As illustrated in FIG. 39, floor panel 3910 may be placed midway along side panels 3915. In particular, floor panel 3910 may be supported using connectors 3945.

Figure 40:
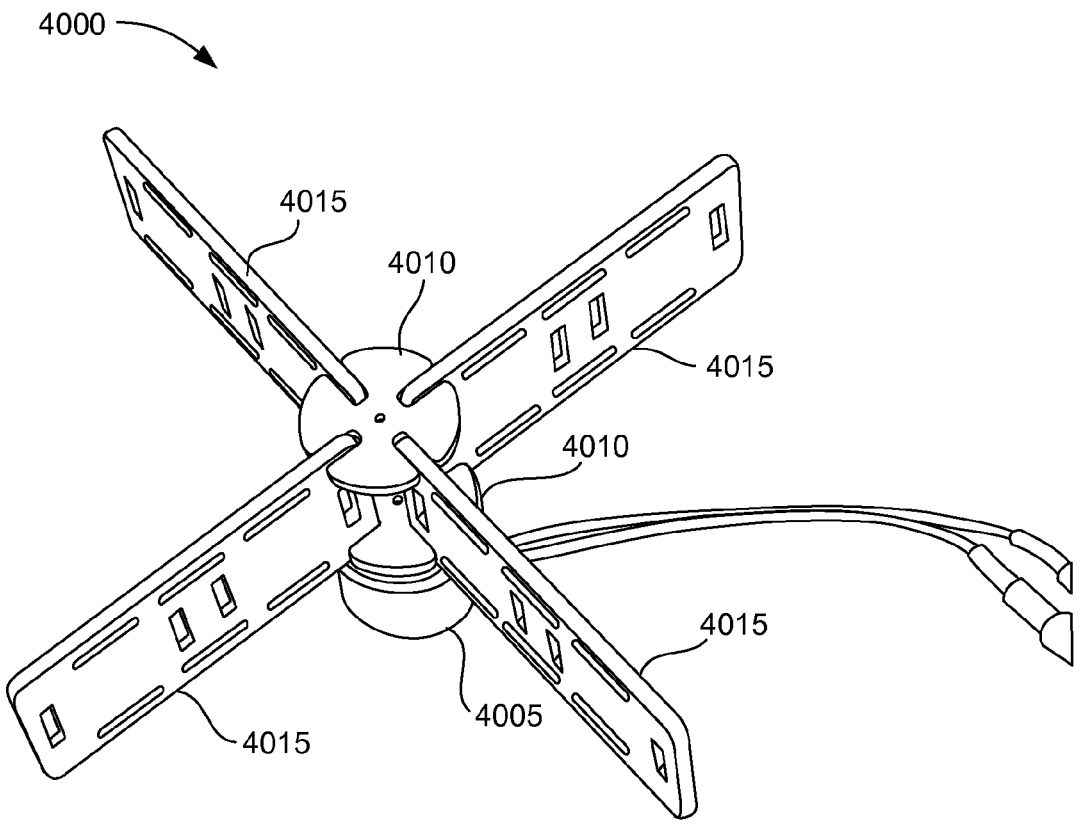
FIG. 40 illustrates a windmill in accordance with embodiments of the present invention.

FIG. 40 illustrates a windmill in accordance with embodiments of the present invention. In particular, FIG. 40 comprises motor 4005, connectors 4010, and panels 4015.

Figure 41:
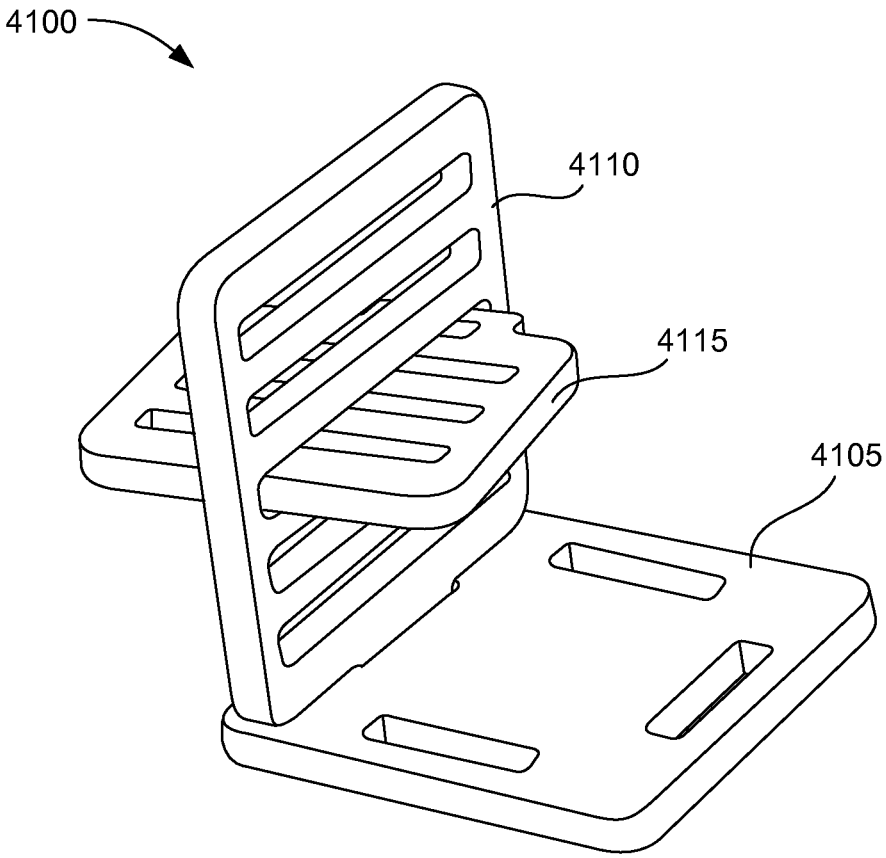
FIG. 41 illustrates a complex configuration of building toy components in accordance with embodiments of the present invention.

FIG. 41 illustrates a complex configuration of building toy components in accordance with embodiments of the present invention. In particular, FIG. 41 comprises four slot building toy component 4105, five-slot, centered tab building toy component 4110, and three-slot, skewed-tab building toy component 4115. As seen in FIG. 41, an entire building toy component, seen here as three-slot, skewed-tab building toy component 4115, may pass through and be securely held within a slot of another building toy component, seen here as five-slot centered tab building toy component 4110.

Figure 42:
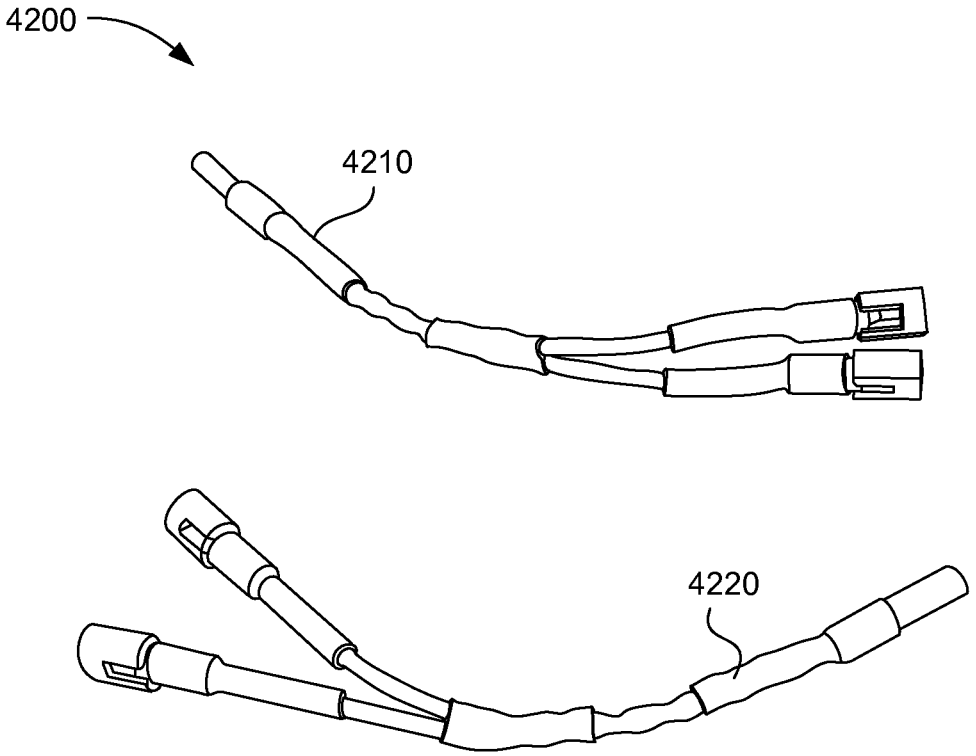
FIG. 42 illustrates two sets of wiring components in accordance with embodiments of the present invention.

FIG. 42 illustrates two sets of wiring components in accordance with embodiments of the present invention. In particular, FIG. 42 comprises a first set of wiring components 4210 and a second set of wiring components 4220.

While this invention has been described in terms of several preferred embodiments, there are alterations, permutations, and substitute equivalents, which fall within the scope of this invention. It should also be noted that there are many alternative ways of implementing the methods and apparatuses of the present invention. It is therefore intended that the following appended claims be interpreted as including all such alterations, permutations, and substitute equivalents as fall within the true spirit and scope of the present invention.

What is claimed is:

1. A building toy component, comprising:

a main body that has a generally circular geometry, the main body having opposing top and bottom surfaces, a radius, and thickness;

at least one radially extending slot that opens on a peripheral edge of the main body, wherein a nominal width of the slot is substantially equal to the thickness of the main body, the slot including opposing sidewalls that are slightly splayed relative to one another such that a width of the slot is wider on the top surface of the main body than at the bottom surface of the main body; and at least one engagement strip within each slot, wherein each engagement strip extends traversely across a sidewall of the slot and tapers along a height of the sidewall.

2. The building toy component of claim 1, wherein the building toy component is formed from a semi-rigid material.

3. The building toy component of claim 1, wherein the top and bottom surfaces are generally parallel.

4. The building toy component of claim 1, wherein the sidewalls are substantially planar.

5. The building toy component of claim 1, wherein the engagement strip is orthogonal to the top surface of the main body.

6. The building toy component of claim 1, wherein the engagement strip has a ridge that is higher at the wider portion of the slot.

7. The building toy component of claim 1, wherein the main body has rounded corners.

8. The building toy component of claim 1, wherein the building toy component is formed using an injection molding process.

9. A building toy component, comprising:

a main body that has a generally rectangular geometry, the main body having opposing top and bottom surfaces, a length, a width, and a thickness;

at least one slot that opens on the top and bottom surfaces of the main body, the slot having a length, a width, and two opposing sidewalls, wherein the at least one slot extends from a first point along the width of the main body to a second point along the length of the main body, wherein the length of the slot equals the thickness of the main body; and at least one engagement strip within each slot, wherein each engagement strip extends traversely across a sidewall of the slot and tapers along the height of the sidewall.

10. The building toy component of claim 9, wherein the distance from the first point and the second point, respectively, on the main body to the nearest respective edge of the main body equals the thickness of the main body.

11. The building toy component of claim 9, further comprising a plurality of engagement strips along the at least one slot.

12. The building toy component of claim 11, wherein the plurality of engagement slots are positioned at a distance that is less than the width of a tab of a compatible building toy component.

13. The building toy component of claim 9, wherein the building toy component further comprises at least one tab that extends through at least one edge of the main body, the tab comprising a length, width, and thickness, wherein the thickness of the tab equals the thickness of the main body.

14. The building toy component of claim 13, wherein the tab snaps into place when it engages a portion of a compatible building toy component.

15. The building toy component of claim 13, wherein a top edge of a tab that is engaged within a slot is flush with a face of the building toy component.

16. A toy room-building kit, comprising:

a building toy component having a main body, at least one tab that extends from the main body, at least one slot that is compatible with the at least one tab, and at least one engagement strip within the at least one slot;

a connector component having a main body, at least one slot that is compatible with the building toy component, and at least one engagement strip within the at least one slot;

a wall panel that is compatible with the at least one slot of the building toy component and the at least one slot of the connector component; and an electronic component having wiring that is of a thickness that is able to be integrated with configurations formed using the building toy component, connector component, and wall panel.

17. The toy room-building kit of claim 16, wherein thickness of the wiring fits within the at least one slot of the connector component.

18. The toy room-building kit of claim 16, wherein at least one slot of the connector component is sufficiently long to secure wiring of the electronic component as well as a portion of the wall panel.

19. The toy room-building kit of claim 16, wherein the semi-rigid material of a tab snaps into place when it engages a portion of a compatible building toy component.

20. The toy room-building kit of claim 16, wherein the engagement strip is substantially orthogonal to top and bottom surfaces of the main body.

* * * * *